US009637874B2

(12) United States Patent
Ganey et al.

(10) Patent No.: US 9,637,874 B2
(45) Date of Patent: May 2, 2017

(54) FORM ASSEMBLY FOR PAVING MATERIALS

(71) Applicant: RFVC Associates, Inc., Fairport, NY (US)

(72) Inventors: Jason Scott Ganey, Edgewater, MD (US); Richard F. Van Cuyck, Fairport, NY (US)

(73) Assignee: R.F.V.C. Associates Inc., Fairport, NY (US)

( * ) Notice: Subject to any disclaimer, the term of this patent is extended or adjusted under 35 U.S.C. 154(b) by 193 days.

(21) Appl. No.: 14/596,418

(22) Filed: Jan. 14, 2015

(65) Prior Publication Data

US 2016/0201276 A1 Jul. 14, 2016

(51) Int. Cl.
*E01C 19/22* (2006.01)
*E01C 19/48* (2006.01)

(52) U.S. Cl.
CPC ..... *E01C 19/4866* (2013.01)

(58) Field of Classification Search
USPC ..... 404/119; 249/2, 3, 4, 6
See application file for complete search history.

(56) References Cited

U.S. PATENT DOCUMENTS 1,169,834 A * 2/1916 Kane ..... E01C 23/023 24/457
1,348,060 A * 7/1920 Sheppard ..... E01C 19/502 238/315
1,512,165 A * 10/1924 Funkhouser ..... E01C 19/502 249/6
1,644,586 A * 10/1927 Heltzel ..... E01C 19/506 249/155
1,911,146 A * 5/1933 Diehl ..... E01C 19/502 249/192
2,663,925 A * 12/1953 Yates ..... E01C 19/502 249/6
3,182,948 A * 5/1965 Lawrence ..... E04G 11/32 249/126
3,377,933 A * 4/1968 Dale ..... E01C 19/405 404/106
3,770,237 A * 11/1973 Burton ..... E01C 11/08 249/3

(Continued)

*Primary Examiner* — Thomas B Will
*Assistant Examiner* — Katherine Chu
(74) *Attorney, Agent, or Firm* — Louis S. Horvath

(57) ABSTRACT

A form assembly for installation of paving materials has elongated form sections, each having a first side wall facing the paving material and an opposite second side wall that has a first longitudinal channel defined between brackets. A number of connector elements join adjacent elongated form sections. Anchor mounting elements have a first coupling member configured to fit into the first longitudinal channel of the form section and a second coupling member configured for coupling to a mounting anchor. Each of the elongated form sections has an upper screed contact surface orthogonal to the first side wall and wherein a first wall thickness between first and second side walls that is between the upper screed contact surface and the first longitudinal channel exceeds a second wall thickness of the form section that is between the first longitudinal channel and a base that is opposite the upper screed contact surface.

15 Claims, 20 Drawing Sheets

(56) References Cited

U.S. PATENT DOCUMENTS 3,785,606 A * 1/1974 Green ..... E01C 19/502 249/170
4,340,200 A * 7/1982 Stegmeier ..... E04G 13/00 249/168
4,340,351 A 7/1982 Owens
4,579,312 A * 4/1986 White ..... E01C 19/506 249/134
4,712,764 A * 12/1987 White ..... E01C 19/502 249/134
5,076,536 A * 12/1991 Fitzgerald ..... E01C 19/502 249/208
5,261,635 A * 11/1993 Flathau ..... B28B 23/00 249/114.1
5,830,378 A * 11/1998 Butler ..... E04G 13/00 249/13
6,010,276 A * 1/2000 Young ..... E01F 1/00 249/219.1
6,021,994 A 2/2000 Shartzer, Jr.
6,536,737 B1 * 3/2003 Davis ..... E04G 17/14 249/210
6,550,213 B1 * 4/2003 Butler ..... E02D 27/00 249/18
6,629,681 B1 * 10/2003 Miller ..... E01C 19/502 249/13
6,866,239 B2 3/2005 Miller et al.
6,874,288 B1 * 4/2005 Washa ..... E04B 1/4157 249/139
7,131,624 B2 11/2006 Bogrett
7,841,576 B2 * 11/2010 Miller ..... E01C 19/502 249/208
8,011,144 B2 * 9/2011 Compton ..... E02D 27/02 249/2
8,215,608 B2 * 7/2012 Oleson ..... E01C 19/502 249/6
2009/0226257 A1 9/2009 Lindley

* cited by examiner

FORM ASSEMBLY FOR PAVING MATERIALS

FIELD OF THE INVENTION

The present invention generally relates to apparatus and methods for paving material installation and more particularly relates to improved forms apparatus for arranging particulate support material and finished paving materials to a desired depth and curvature. Reference is made to commonly assigned pending U.S. patent application Ser. No. 13/864,390, publication number US 2014/0314482 by Ganey.

BACKGROUND

Construction of quality walkways, driveways, patios, pool decks, retaining walls and footers, garden perimeters, and other similar structures is a labor-intensive process, typically requiring a number of steps, each step subject to stringent quality and performance requirements. Failure to meet set standards can be frustrating and costly, often causing rework and accompanying delays.

Using conventional construction methods, a trench is first prepared to a depth that allows for specified thicknesses of particulate substrate material that serves as a base, such as gravel, small stones, and sand. This base, in turn, supports the finished paving materials at the proper height, usually at or near ground level. Finished paving materials that are then placed upon the base can include paving blocks, stones, or bricks, or may include poured concrete or other materials. The width of the trench is significantly larger than the width of the finished walkway or other structure due to the need to provide sufficient space for forms to be inserted, manipulated and supported along the sides of the trench. Requiring time and effort that are not seen in the finished product, the process for providing the needed excess width, termed over-digging by those skilled in the construction arts, is inherently wasteful.

To assist in the substrate lay-down process, forms inserted on both sides of the trench are used to contain the particulate substrate materials and also provide a reference for arranging the finished paving material. There are many types of forms that can be used, including wood, plastic and metal forms. Wooden forms can warp undesirably and are not generally reusable, flexible, or easy to install. Plastic forms serve only in lightweight applications and are not sturdy enough to withstand the rigors of the construction environment and not rigid enough to contain heavy materials or bear the weight of a screed. Metal forms are heavy, costly to replace, troublesome to assemble, and relatively inflexible, requiring careful cleaning after use to remove any affixed concrete.

The forms are anchored in place in a number of ways, using devices such as wooden stakes, rebar, or metal stakes devised for the purpose of anchoring forms so that they remain in place as the structure is assembled. Forms are fastened to the anchors using fasteners such as clips, nails, and spacers, for example.

Leveling the forms along any section of a walkway or other structure can be a difficult task. Mistakes or tolerance errors can be additive, further complicating the leveling process.

Once the forms are set in place, the trench or gap is leveled. The term "level" does not imply that the surface of the trench need be completely flat; the term "level" is used to denote creating a smoothed continuous surface without significant high or low areas to allow depositing a layer of substrate at an essentially uniform depth.

When the dirt in the trench has been leveled, the particulate material is deposited between the forms and also leveled. To achieve a uniform depth of material, the substrate material is typically tamped down with a vibratory plate compactor or by a hand compactor. In practice, application and leveling of the substrate material is accomplished by dumping or by sifting the material into the prepared trench from wheelbarrows or other construction machinery such as front loaders. The volume of material that is dumped at any one time is calculated to spread somewhat evenly and reduce excessive raking and handling.

Using the example of a walkway, gravel is deposited as a first or substrate layer. This is then spread and leveled. This process can begin and be assisted with construction machinery, but, as it progresses, typically requires hand leveling with rakes and screed bars to the desired depth. To provide a solid base, the gravel is tamped down with a vibratory plate compactor or by a hand compactor. The cycle of depositing material, spreading, and tamping is repeated with stone dust and sand or other particulates as required, until the surface is properly conditioned for bricks or other finish materials. When all the desired layers are in place, the finished layer of paving blocks, bricks or concrete is put in place to complete the walkway.

Although the process of surface preparation for a walkway or other structure is straightforward, the preparatory steps to prepare the support structures can be challenging. In practice, these steps are often redone, since accurate leveling at the desired depth for each layer is difficult. Thus, there is a need for improved apparatus and methods for preparation and conditioning of a support base for walkways, driveways, patios, pool decks, retaining walls and footers, garden perimeters, masonry, and other similar structures.

Proposed solutions for installation of materials for a walkway or other structure are less than satisfactory. For example:

(i) U.S. Pat. No. 6,866,239 to Miller et al. discloses a form assembly for forming a concrete structure during drying of the concrete. The form assembly is an elongated plastic form having a front wall for engaging the concrete, and a rear wall. The front wall is spaced apart from the rear wall to define a pocket for receiving at least one connecting member. The connecting member is secured in the pocket to project a distance beyond an end of the form. A slidable stake holder may also be provided to slide in a C-shaped pocket in the form. The stake holder has right and left flanges that abut against or engage the rear wall. At least one preformed nail hole is provided in each of the right and left flanges. The forms do not indicate desired depth of materials. Connecting members secured in the pockets render the form inflexible at the joint between forms. Unfortunately, the distance from the front wall of the form to the aperture in the sliding stake holder for holding a stake is fixed, making it difficult to set distance between forms on opposite sides of the walkway, complicating lateral placement of the form with the stake accurately placed. Additionally, the sliding stake holder is not fixably engaged with the form by a connector screw or clamp; as a result, sliding, possible while particulate materials are being added between forms, can result in errors.

(ii) U.S. Pat. No. 7,131,624 to Bogrett teaches flexible forms for creating landscape edging. However, stakes or positioning brackets used to secure the forms are not reusable, and additional spacers are needed to maintain the distance between forms, making it difficult or impractical to place paving blocks. Joining extensions are created from the same material as the forms and are not intended to be reusable and do not appear to facilitate accurate longitudinal adjoining of forms.

(iii) U.S. Pat. No. 6,021,994 to Shartzer teaches a flexible form for use in pouring concrete. Rigid core members are added to maintain strength but removed when flexibility is desired. Stakes protrude through the forms and connection to the form is made only via the rigid core members with nails, complicating the task of positioning the forms. Since the rigid core members are removed when the forms are bent, however, securing the stakes to the form is not possible.

(iv) U.S. Pat. No. 4,340,351 to Owens teaches a screed fabricated in modular fashion from a plurality of interconnected, separable frame units. Modular sections forming the screed can be connected to provide a convex or concave screed depending on the shape of the desired surface. However, the screed formed from modular sections is a complicated assembly, difficult to fabricate, and does not provide adjustment appropriate to the desired depth of layers of particulate material.

There exists a need to improve the quality of tools used in creating layers of material for supporting particulate and finished paving materials which eliminate much of the expertise required for substrate preparation and reduce unnecessary rework.

SUMMARY OF THE INVENTION

Embodiments of the present invention address the need for improved apparatus and methods for depositing and preparing surface particulate, stone, bricks, concrete, and related materials in a suitable arrangement for paving installation.

In accordance with one aspect of the present invention there is provided a form assembly for installation of paving materials, the form assembly comprising:

a) one or more elongated form sections, wherein each of the one or more elongated form sections has a first side wall for facing the paving material and an opposite second side wall, wherein at least a first longitudinal channel is defined between corresponding first and second brackets that extend from the second side wall;

b) a plurality of connector elements for joining adjacent elongated form sections, wherein each connector element has at least one fastener and a crosspiece member that seats within the at least the first longitudinal channel of the adjacent form sections;

c) one or more anchor mounting elements, wherein each anchor mounting element has a first coupling member that is configured to fit into at least the first longitudinal channel of the form section and a second coupling member that is configured for coupling to a mounting anchor;

wherein each of the one or more elongated form sections has an upper screed contact surface that is orthogonal to the first side wall and wherein a first wall thickness between first and second side walls of the form section that is between the upper screed contact surface and the first longitudinal channel exceeds, by at least about 10%, a second wall thickness of the form section that is between the first longitudinal channel and a base that is opposite the upper screed contact surface.

Advantageously, embodiments of the present invention provide a solution for paving installation that is readily scalable and usable for walkways and other structures of various widths that can have straight and curved sections and that use a wide range of particulate and finished materials.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

Embodiments of the invention will now be described with reference to the drawings in which.

DETAILED DESCRIPTION OF THE INVENTION

Figure 1A:
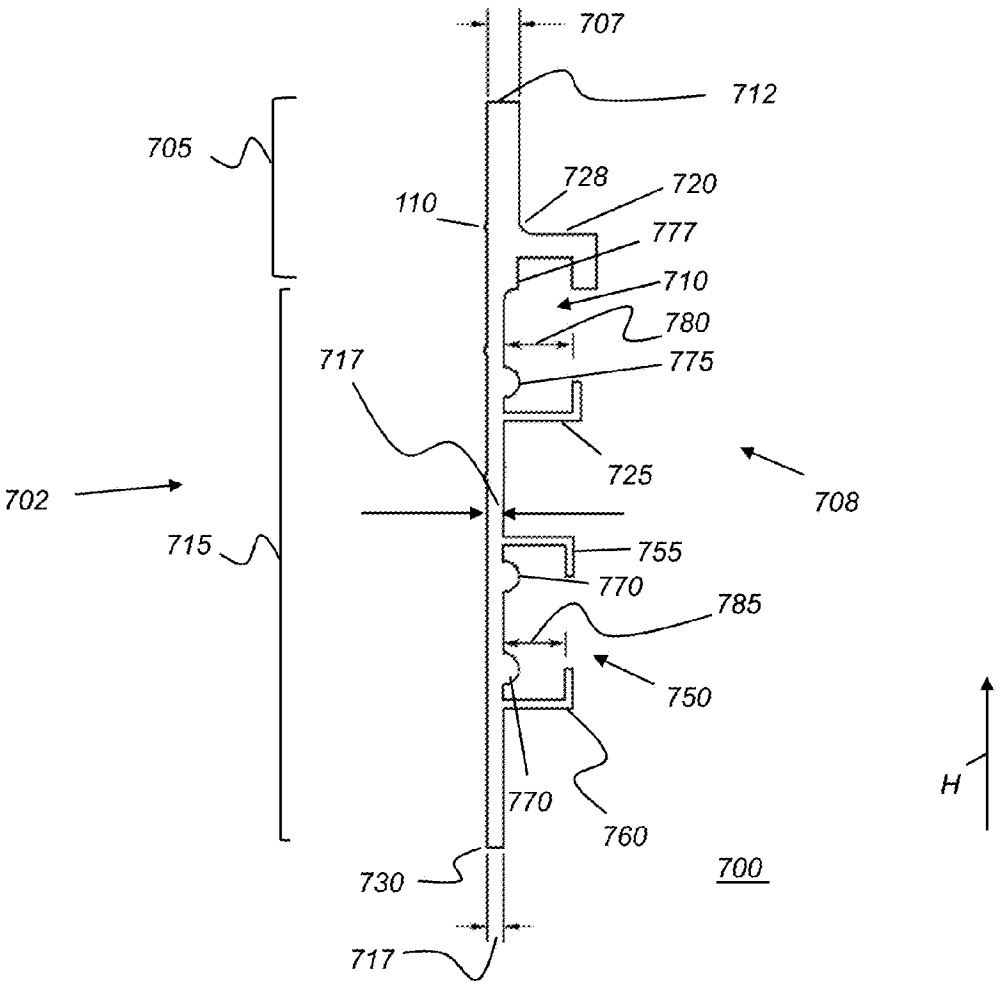
FIG. 1A is a cross sectional view of a form according to an embodiment of the present invention.

Figures shown and described herein are provided in order to illustrate key principles of operation and fabrication for an apparatus according to various embodiments and a number of these figures are not drawn with intent to show actual size or scale. Some exaggeration may be necessary in order to emphasize basic structural relationships or principles of operation.

In the context of the present disclosure, terms "top" and "bottom" or "above" and "below" are relative and do not indicate any necessary orientation of a component or surface, but are used simply to refer to and distinguish opposite surfaces or different portions of a material. Similarly, terms "horizontal" and "vertical" may be used relative to the figures, to describe the relative orthogonal relationship of components, for example, but do not indicate any required orientation of components with respect to true horizontal and vertical orientation.

Where they are used, the terms "first", "second", and so on, do not necessarily denote any ordinal or priority relation, but are used for more clearly distinguishing one element or time interval from another. There are no fixed "first" or "second" elements in what is taught herein; these descriptors are merely used to clearly distinguish one element from another similar element in the context of the present disclosure.

In the context of the present disclosure, the term "paving materials" relates to any of a number of types of finish material, such as bricks or paving tiles, or particulate material that is laid down and formed as part of a base for a tiled or paved surface or wall structure. The paving material may be dry, as in the case of bricks, sand, gravel, or crushed stone, or may be mixed with a liquid, as in the case of concrete, asphalt, or other material. Forming of the material may include various operations used to distribute, shape, condition, or compress the particulate materials, such as spreading, tamping, leveling, rolling, wetting, drying, troweling, and other operations, for example.

In the context of the present disclosure, the term "oblique" describes an angular relationship that is not parallel or normal (orthogonal), that is, other than an integer multiple of 90 degrees. In practice, two surfaces are considered to be oblique with respect to each other if they are offset from parallel or from normal or orthogonal by at least about +/−10 degrees or more. Similarly, a line and a plane are considered to be oblique to each other if they are offset from parallel or orthogonal by at least about +/−10 degrees or more.

In the context of the present disclosure, the term "piecewise parallel" has its standard meaning, indicating that two structures may follow the same curved path and extend substantially in parallel at any point along the path. Forms that are on opposite sides of a curved walkway are piecewise parallel when an extended line that is substantially perpendicular to one edge intersects the opposing edge substantially at a perpendicular. In the context of the present disclosure, two lines are substantially perpendicular or orthogonal where their angle of intersection is within 80-100 degrees.

The terms "track" and "channel" are used interchangeably in the description that follows and refers to a longitudinal cavity that is defined within structures or features that extend in the length direction.

Embodiments of the present invention address the problem of paving material installation by providing configurable, flexible forms that are straightforward to setup, allow easy adjustment to accommodate paved surfaces that extend along straight line or curved segments, are constructed to handle the added weight and stress caused by moving a screed along the top of the assembled forms, and are lightweight, reusable, and at lower cost when compared with conventional forms. The form of the present invention has an interlocking arrangement that enables scalable layout of forms in various arrangements for laying pavement and allows forms curvature to a level of at least one meter radius or longer. The thickness of portions of the form is adapted to allow flexibility while also handling the weight and friction forces caused by a mechanical screed.

Referring to FIG. 1A, there is shown a cross-sectional view of a form 700 according to an embodiment of the present invention. Form 700 is elongated in a length direction that is orthogonal to (coming out of) the page. Form 700 is a single, continuous length that has an upper section 705 and a base section 715. Upper section 705 extends from a screed contact surface 712 to just within the longitudinal channel of a first track or channel 710 that extends from an outer connector side wall. Base section 715 extends from a base 730 to the nearest boundary of the upper section 705. Upper section 705 is less than half the height of base section 715 (with height H in the vertical direction as shown in FIG. 1A) but differs from base section 715 in wall thickness between inner materials side wall 702 and outer connector side wall 708. A wall thickness dimension 707, between side walls 702 and 708, for upper section 705 is sized to support the force exerted by a screed that is dragged against a screed contact surface 712. Screed contact surface 712 is orthogonal to side wall 702. A wall thickness dimension 717 for base section 715 can be thinner than dimension 707 to allow improved forms 700 flexibility, for example. According to an embodiment of the present invention, dimension 717 is less than 0.9 times dimension 707. Dimension 717 can alternately be less than 0.75 times dimension 707 and can even be as little as 0.5 times dimension 707. The thickness dimension 707 that is between inner materials side wall 702 and outer connector side wall 708 between the upper screed contact surface 712 and the upper longitudinal channel 710 exceeds the thickness dimension 717 of the form section that is between the upper longitudinal channel 710 and the lower longitudinal channel 750. For single-channel embodiments, the thickness dimension 707 that is between inner materials side wall 702 and outer connector side wall 708 between the upper screed contact surface 712 and longitudinal channel 710 exceeds the thickness dimension 717 of the form section that is between the longitudinal channel 710 and the base 730 that is opposite the upper screed contact surface 712.

It should be noted that using reduced thickness toward the base, as described with reference to dimensions 707 and 717 in FIG. 1A, is a counter-intuitive approach for design of supporting structures, such as forms used to define the edges of paving materials. In conventional practice, supporting structures are designed to be thicker along the base than along upper portions, for weight-bearing and stability. However, the Applicants have found that using this innovative approach, with wall thickness in a reversed relationship, has advantages for weight and handling in paving materials installation, without compromising the overall utility and performance of the forms assembly. This arrangement takes advantage of the process by which successive paving materials are layered to build up a paved surface between the forms, with anchor mounting elements 820 and connectors 800 providing a measure of support against lateral stress that is applied against inner materials side wall 702. The added thickness toward the top portion of the form section 700 helps to support the weight of screeding equipment.

Particulate and other paving materials are placed and packed against inner material side wall 702. Connectors (described in detail subsequently) are fitted into upper and lower channels 710 and 750, respectively, that extend along outer connector side wall 708 that lies opposite inner materials side wall 702. Upper first track or channel 710 extends in the length direction and is defined between guide brackets 720 and 725 that extend outward from outer connector side wall 708. Lower second track or channel 750 similarly extends in the length direction and is defined between guide brackets 755 and 760 that extend outward from outer connector side wall 708.

For upper track 710, guide bracket 720 extends outward from upper section 705 and is substantially thicker than guide bracket 725 of upper track 710 that extends outward from base section 715, such as about 1.5 times thicker. The thicker guide bracket 720 has a radius 728 for further strength in handling the force exerted by screed operation. Additional connectors used in optional lower track 750 help to constrain pavement materials and prevent or reduce flaring outward, in the direction of outer connector side wall 708. In addition to constraining paving materials, additional connectors used in lower track 750 help to keep screed contact surface 712 in place, simplifying placement and adjustment of form 700.

The upper and lower tracks 710 and 750 also contain ridge features 770, 775 that contact a connector assembly, as shown subsequently, and help to provide an improved connection in both straight and curved configurations of form 700. Ridges 777, 775, and 770 provide contact surfaces that urge a connector, shown subsequently, against brackets 720, 725 and 755, 760 that define tracks 710 and 750, respectively. In lower track 750 of FIG. 1A, ridges 770 are of equal size and shape. Ridges 770 can extend fully along the length of channel 750. Tracks 710 and 750 are used to align successive forms 700 in sections order to provide a continuous length of forms on each side of a road or pathway to be paved. Embodiments of the present invention allow any number of forms to be joined together using connectors shown subsequently.

In upper channel 710, a lower ridge 775 is of different shape than an upper ridge 777. Upper ridge 777 is formed by continuing the thicker cross sectional area of upper section 705 into channel 710. This shape of ridge 777 provides additional strength for transferring the downward force of the screed to the connector assembly. Lower ridge 775 protrudes outward from the surface of base section 715 within track 710.

Figure 1B:
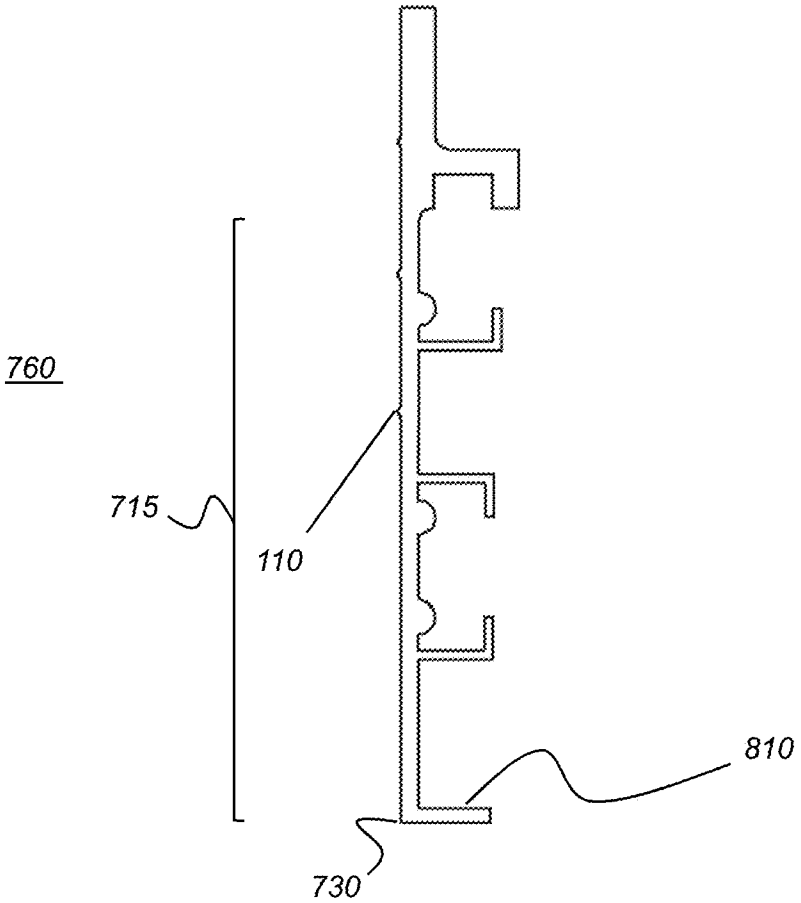
FIG. 1B is a cross sectional view of an alternate form similar to that shown in FIG. 1A with an added foot element portion.

FIG. 1B shows an alternate embodiment, also in side view, with a form 760 that has an added foot element 810 along base 730 for increasing stiffness along its length. Added stiffness is advantageous when using form 760 to create a straight path, for example.

Figure 1C:
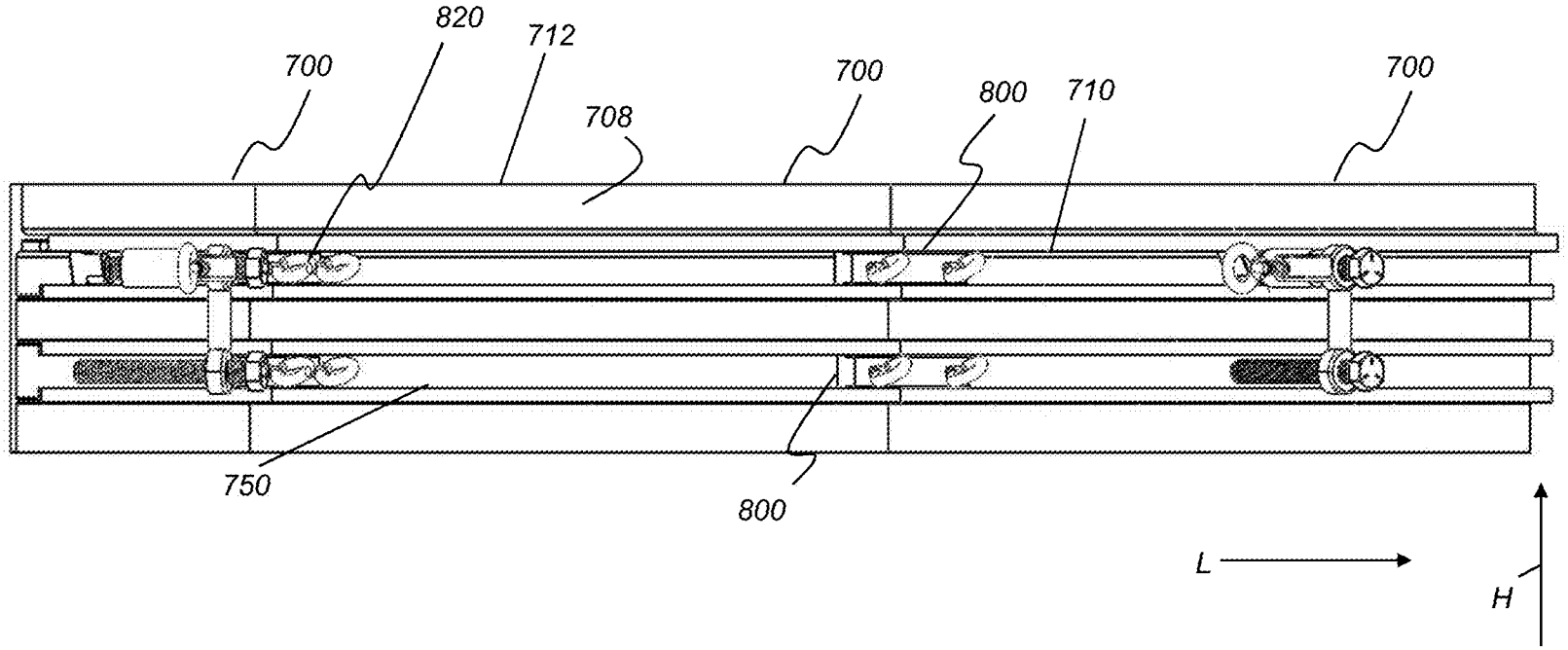
FIG. 1C is a plan view that shows how form sections are joined.
Figure 1D:
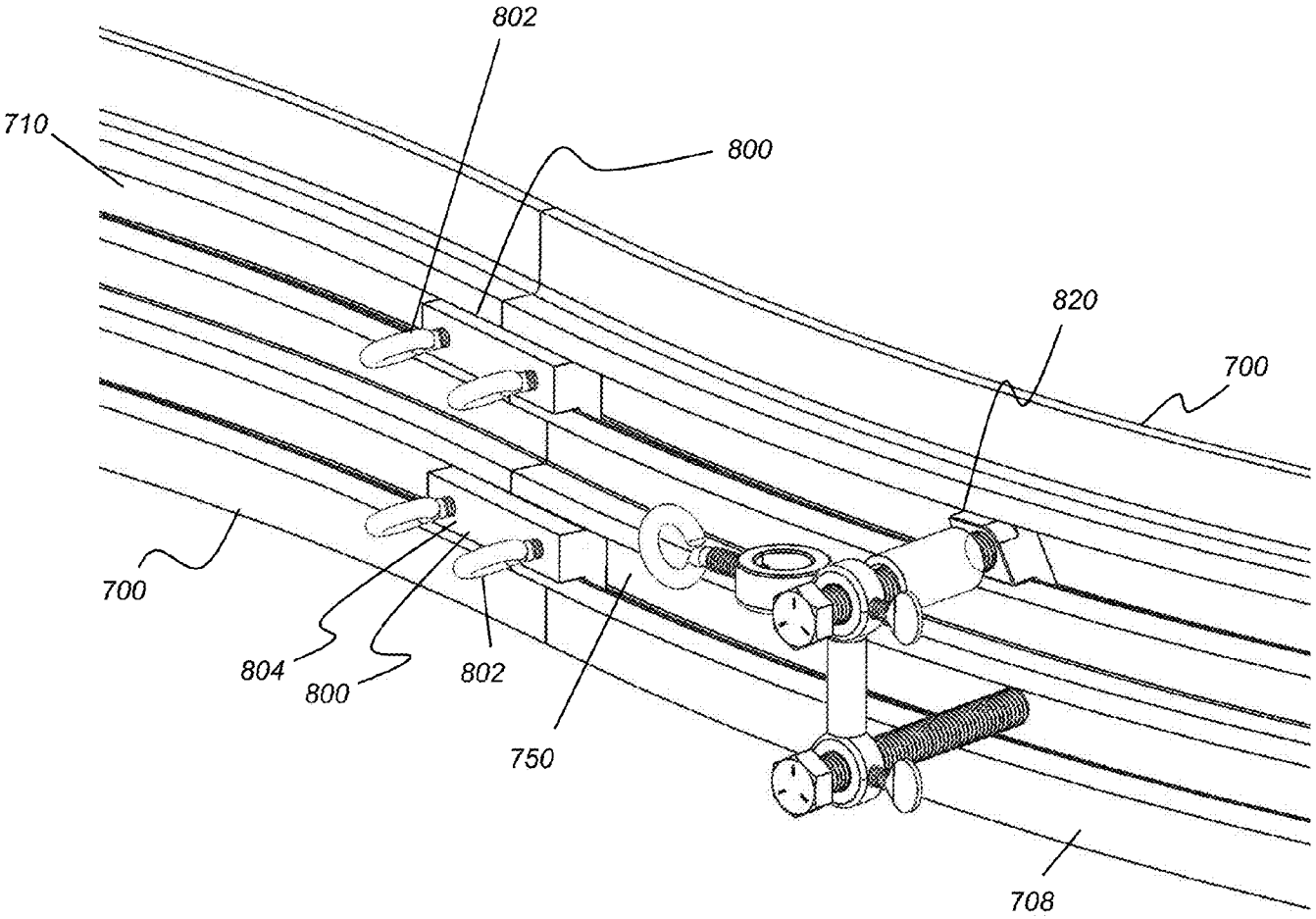
FIG. 1D is a perspective view that shows how form sections are joined.
Figure 1E:
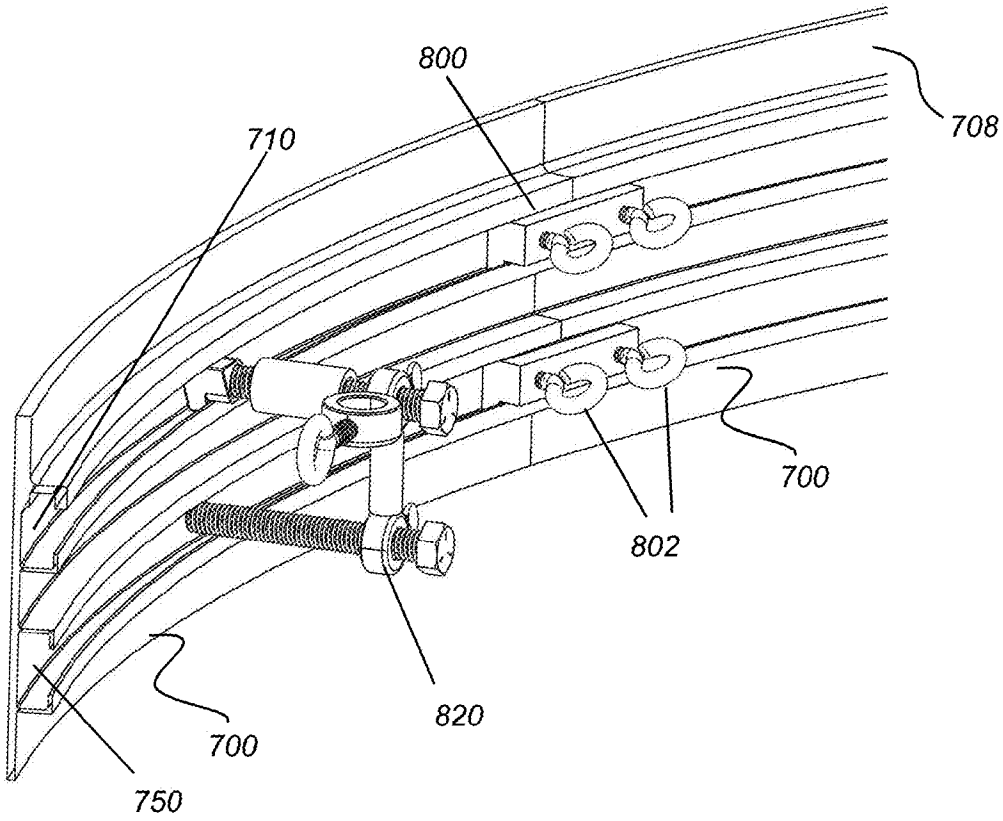
FIG. 1E is a perspective view that shows how form sections are joined.
Figure 1F:
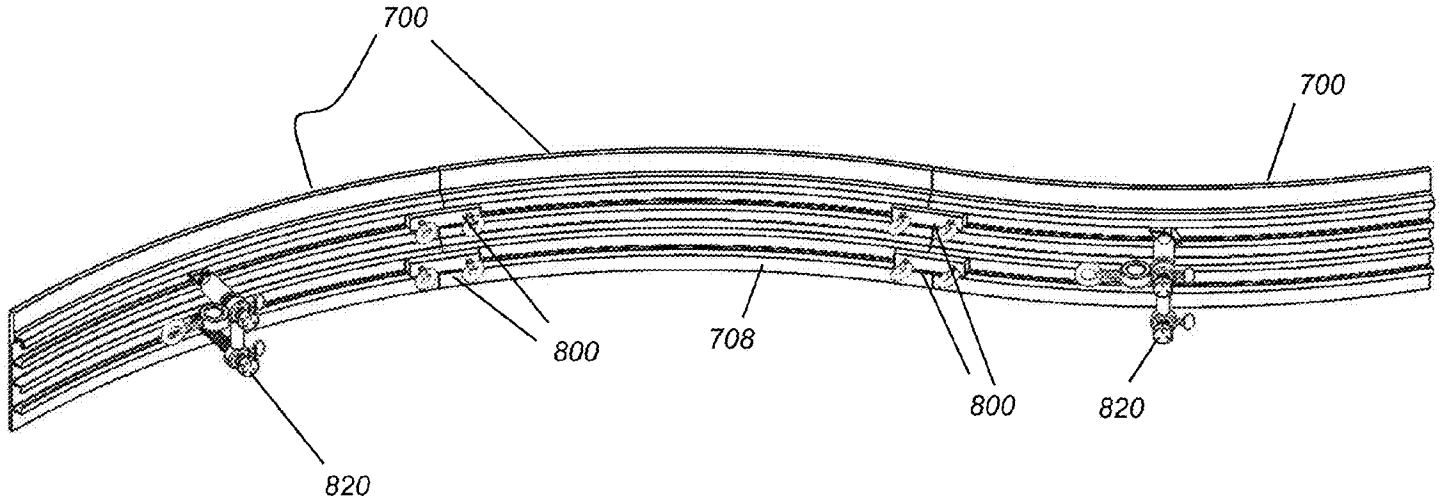
FIG. 1F is a perspective view from the connector side showing three form sections joined.
Figure 1G:
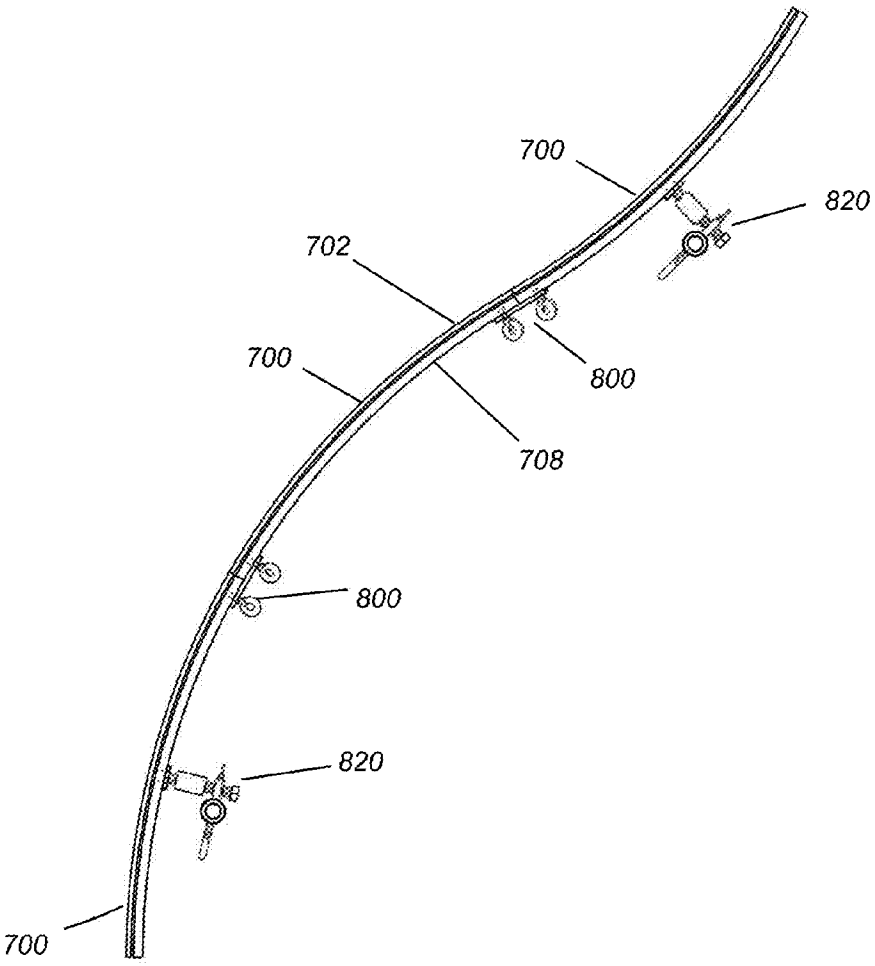
FIG. 1G is a top view showing three form sections joined.
Figure 1H:
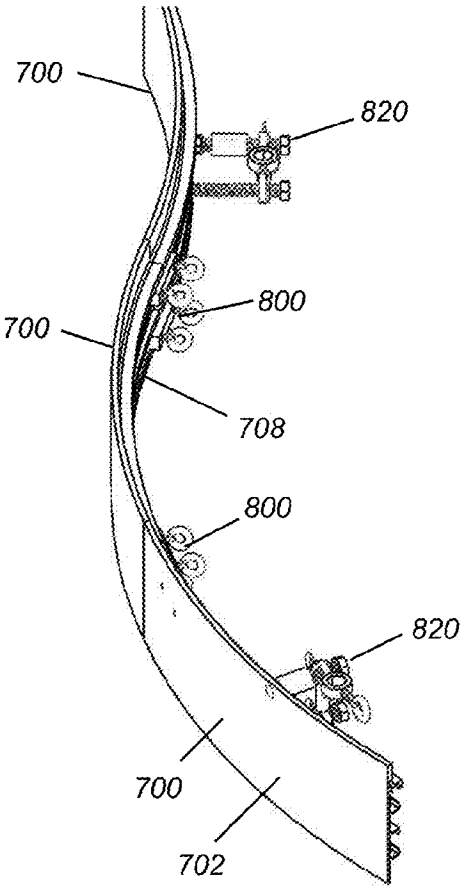
FIG. 1H is a perspective view from the paving materials side showing three form sections joined.

FIGS. 1C and 1D show how forms 700 are joined together by connector elements to form a form assembly that defines a variable-length side border for a straight stretch of pavement. A length direction L is the direction along which the elongated forms 700 are extended. Section connectors 800 are connector elements that are fitted into tracks 710 and 750 and provide fasteners 802, held in the crosspiece member 804 and tightened to maintain a crosspiece member 804 of each connector 800 in place. Anchor mounting elements 820 also fit into the tracks 750, 710 for attachment to anchors or stakes. FIGS. 1D and 1E show forms 700 joined and forming curved pavement segments. FIGS. 1F, 1G, and 1H show, from different perspectives, a curved edge formed using three forms 700 with the configuration and interconnecting hardware described herein.

Figure 2A:
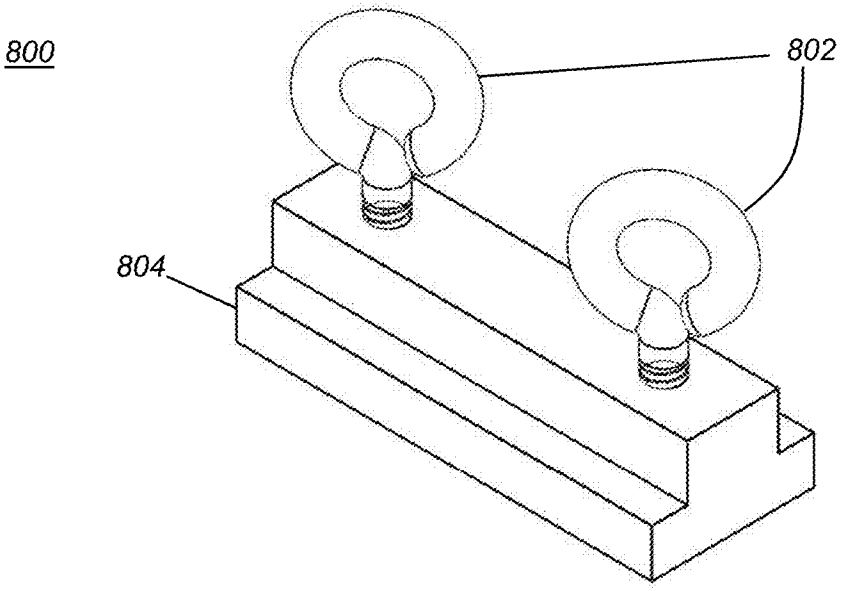
FIG. 2A shows a sectional connector used to connect adjacent forms to each other.

FIG. 2A shows a section connector 800, which is fitted within tracks 710 and 750 to connect adjacently positioned forms 700 to each other. A crosspiece member 804 is an element that is featured and dimensioned to seat within tracks 710 or 750 of two adjoining forms 700. One or more fasteners 802 then tighten crosspiece member 804 into position by applying pressure against ridges 770, 775, 777 or directly against outer connector side wall 708 of each of the adjacent forms. Adjacent forms 700 that are coupled together using connectors 800 can then be handled and positioned as a single unit.

Referring back to FIG. 1A, ridges 770 have a cross-sectional area that is adequate to provide contact and friction against connector 800 of FIG. 2A without interfering with the flexibility of form 700. This is also true of ridge 775. Ridge 777 has a greater cross sectional area than ridge 775. To compensate for the loss in flexibility due to this greater cross sectional area, a channel depth 780 of channel 710 (FIG. 1A) is slightly larger than that of channel depth 785 of channel 750. The difference in depth between the two channels 710 and 750 is typically less than 10% of the larger depth 780, so that depth 785 of channel 750 does not exceed 0.9 times the depth 780 of channel 710.

Note that as form 700 is flexed, the forces holding form 700 in place against anchor mounting element 820 tend to increase; form 700 is then less apt to move relative to the position of anchor mounting element 820. Note also that when flexed, the resistance of form 700 to the downward force of the screed increases, since form 700 is not constrained to a single plane.

Figure 2B:
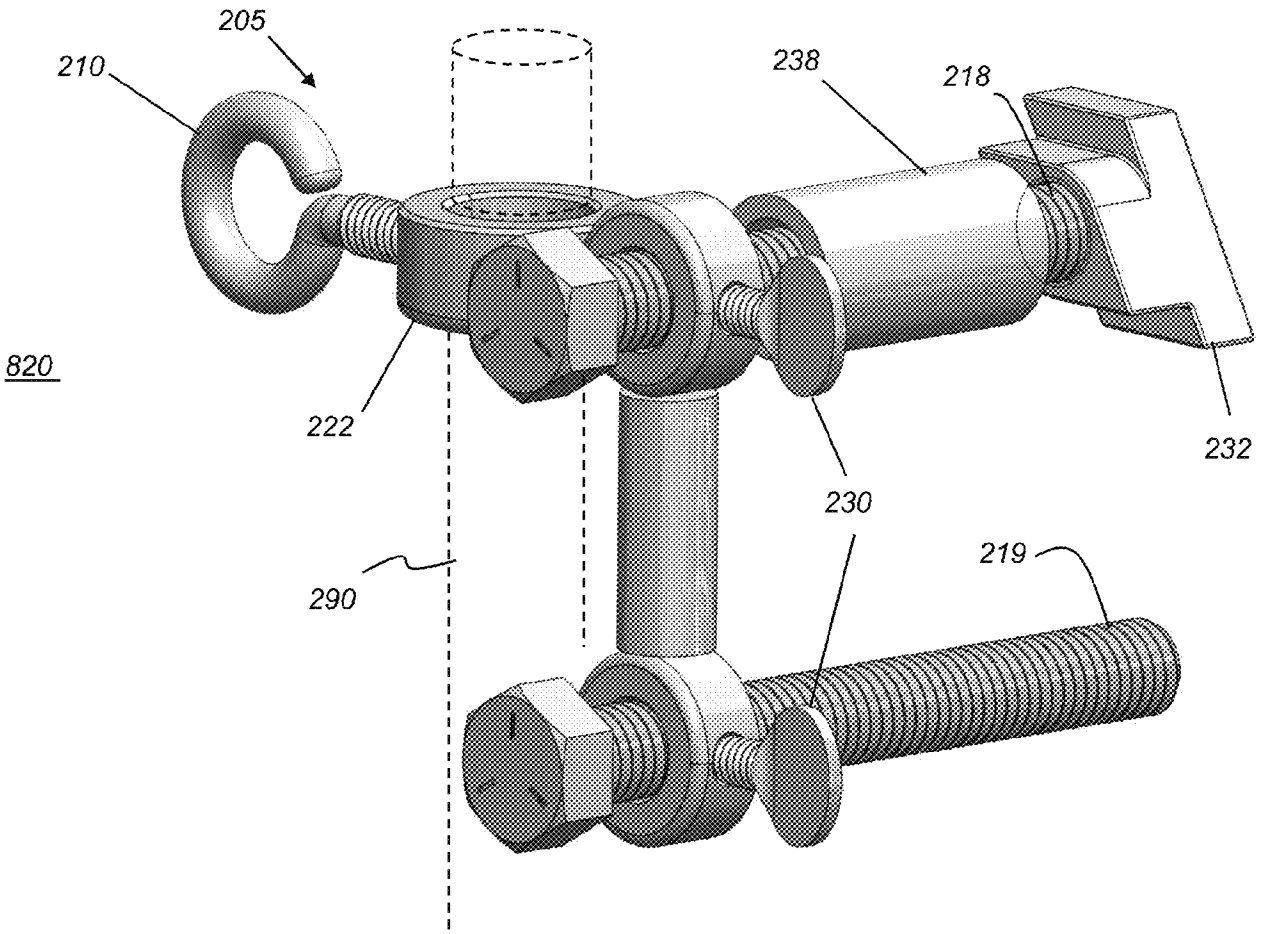
FIG. 2B is a perspective view that shows a connector assembly used to connect forms to an anchor or stake.

FIG. 2B depicts an anchor mounting element 820 that couples a form 700 to an anchor 290 such as a mounting stake, its position shown in dashed outline in FIG. 2B, for holding form 700 in position. Anchors 290 are typically rebar or some other commonly available staking device. A clamp is an exemplary type of coupling member 205 that can be used to secure anchor mounting element 820 to anchor 290. A tightening knob 210 holds anchor 290 in position within a ring 222. A spacer 238 provides a minimum separation distance of a clamping foot 232 or other suitably configured coupling member along the shank of a bolt 218, shown as a threaded bolt in FIG. 2B.

Clamping foot 232, as shown in FIG. 2B, is configured to be slidably contained within brackets 720, 725 (FIG. 1A) so that its longitudinal position is adjustable and to couple anchor mounting element 820 to form 700 when mounting element 820 is suitably adjusted, such as using threaded bolt 218, for example. Wing nuts 230 set the distance of ring 222 from form 700. Another bolt 219, also shown as a threaded bolt in FIG. 2B, adjusts to apply pressure against form 700 for holding form 700 in place relative to anchor 290. Various washers and nuts can be added to anchor mounting element 820 to facilitate its function. Bolts 218 and 219 need not be threaded. Bolt 218 functions to provide a support shaft for clamping foot 232, spacer 238, and coupling member 205. Wing nut 230 can affix coupling member 205 ring 222 to either a threaded or non-threaded shaft. Although not shown in FIG. 2B, bolt 219 may alternately also have a clamping foot 232 affixed to its end for coupling against form 700; this clamping foot can be used in channel 750 in the same fashion as clamping foot 232 is in channel 710.

Figure 2C:
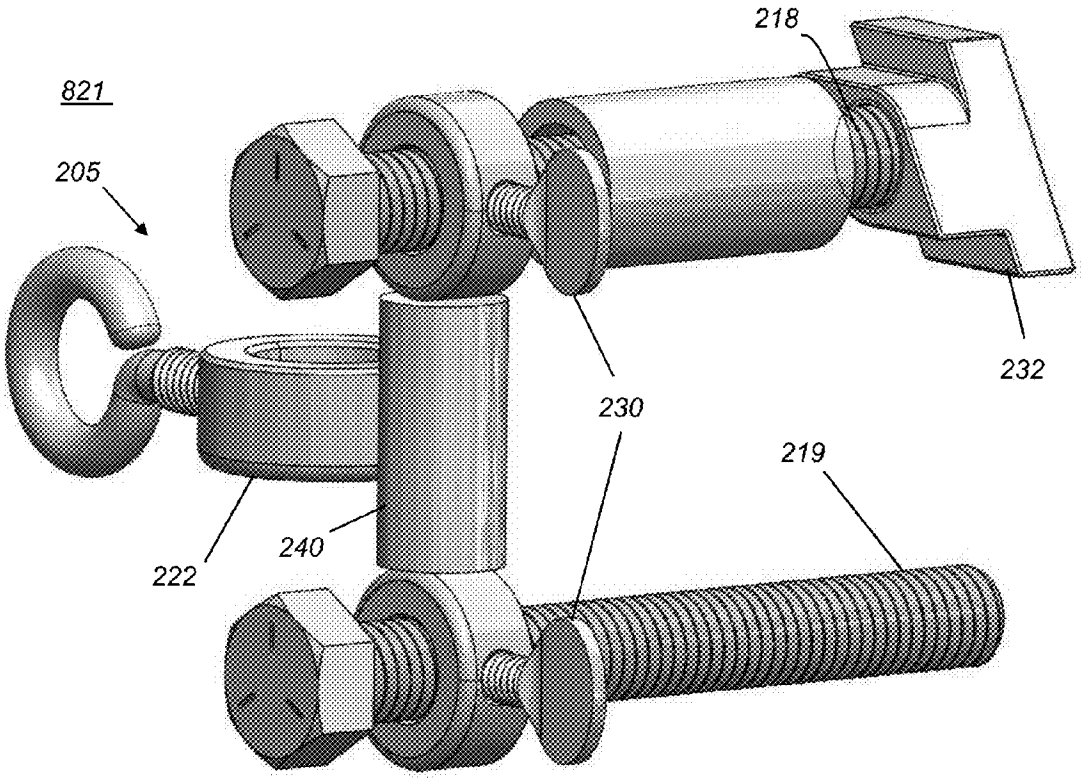
FIG. 2C is a perspective view according to an alternate embodiment that shows a connector assembly used to connect forms to an anchor or stake.

FIG. 2C shows an anchor mount 821 according to an alternate embodiment in which ring 222 is provided coupled to a shaft 240 at a position between bolts 218 and 219. Tendency for twisting or rotation is further constrained in this configuration.

Bolt 219 is clamped in place and holds anchor mount 820 out from form 700 at a desired extension, set by wing nut 230. Form 700 is thereby constrained laterally against the force of particulate paving materials that apply force in the gap between forms 700. Positional stability is further provided along the top of form 700, allowing form 700 to be set in place with a laser level, for example, or with other types of leveling tools, including conventional bubble-in-glass levels.

The positional flexibility of anchor mounting element 820 or 821 provides substantial time savings over prior art connectors. Anchor mounting element 820, 821 is easily adjusted in all three orthogonal axes relative to forms 700 to accommodate situations where anchor 290 is not set in place normal to the ground. Anchor mounting elements 820 and 821 are also compatible with form 700 configurations that use only a single track or channel.

Material Composition

According to an embodiment of the present invention, forms 700 can be formed from reusable and flexible plastic and are lightweight, easily manipulated by construction workers to simplify the paving of walkways, sidewalks, patios, pool decks, drive ways, retaining wall footers of all sizes, garden perimeters, concrete walkways, driveways, pads, masonry, and other outdoor structures. While plastic is advantaged for forms 700, other materials, such as aluminum and composites containing plastics, metals, and binders such as epoxies can be used.

Embodiments of the present invention are advantaged in providing forms of reduced weight over forms that have been designed conventionally. This weight advantage is obtained by fabricating the forms with a thinner wall along base section 715, as was described previously with respect to FIG. 1A. A form having walls of uniform thickness can be much heavier than the form shown in FIG. 1A. It has been determined experimentally, for example, that a 10 foot long section of an extruded form, generally similar to the type shown in FIG. 1A, but with a uniform thickness over its full height that is sufficiently thick to support the downward force of the screed, can weigh approximately 20 pounds. Such a form could be composed of CMR 4950, CMR 4240, or CMR 3950 Rigid PVC (polyvinyl chloride) Compound from Color Master, Inc. Kendallville, Ind. By comparison, the form 700 of the present invention, with its reduced cross sectional area over base section 715 and its arrangement of thin brackets 725, 755, and 760 for coupling with adjacent forms 700, can weigh less than about 7 pounds and still have sufficient sturdiness for field use and support of a screed. This weight advantage translates into corresponding shipment cost savings, space savings, and ease of use and handling.

It may be desirable to provide different types of forms, some of which are flexible to facilitate curved paths, and some of which are straight. As was shown in FIG. 1B, for example, adding foot element 810 to the base of lower section 715 of form 700 of the invention provides greater longitudinal stiffness, which facilitates installations where curvature is not desired. Note that foot element 810 is provided in a manner that increases stiffness significantly while minimally increasing the weight of form 700.

Referring back to FIG. 1A, forms 700 may also have one or more integral depth indicators 110 on inner side wall 702 facing the particulate and paving materials. Depth indicators 110 can be notched, grooved, dimpled, painted, molded, or otherwise marked on inner side wall 702. Depth indicators 110 simplify determining the level of particulate material used as a base, such as to meet layer depths dictated by various standards such as ASTM C 33, Standard Specification for Concrete Aggregates by ASTM (American Society for Testing and Materials) International, West Conshohocken, Pa., for example. Depth indicators 110 can significantly reduce the time and effort needed to measure and provide the desired depth of particulate materials. Depth indicators 110 provide a visual reference that allows workers who are depositing and compacting particulate materials to know at a glance if the desired depth has been reached.

Forms 700 can be manufactured in preformed lengths, typically 20, 16, 12, 10, or 6 feet long, and can be cut to any length. According to an embodiment of the present invention, forms 700 are fully pliable, lightweight, and easy to measure and cut.

FIG. 1C shows a plan view of connector side wall 708 for joined forms 700 that have been connected using connectors 800. Forms 700 provide improved flexibility along length dimension L without compromising strength in a vertical height direction H, thus providing the ability to create curved pathways. Even though they are minimally flexible along length dimension H, forms 700 can also have great strength in height direction H, so that forms 700 resist collapsing or deforming under the weight and pressure of the screed moving along length direction L across the screed contact surface 712 of forms 700 with added weight of a machine such as a Skid Steer Loader S100 from the Bobcat Company, headquartered in West Fargo, N. Dak., or a walk behind skid steer Dingo TX 427 from the Toro Company of Bloomington, Minn.

The forms can be produced in any color supported by the plastics or other materials used to manufacture the form. However, the preferred color of the form of the invention is white. This color is advantageous since it absorbs minimal heat from sunlight. Most installations are in full sunlight, so the heating effects of the sun are significant. If the forms become too hot, they can reach a temperature where the strength of the plastic decreases, and structural performance of the forms can be compromised. With light-colored forms, there is enhanced capability to support the downward force of the screed under intense sunlight conditions, the ability to constrain particulate material without undue concern for distortion or expansion, and relaxed clamping force requirements for on the connector assemblies. Additionally, if the forms become too hot, they can become difficult to handle for the workers installing them, even capable of causing burns. The need for using insulating gloves for installation can be undesirable. Thus manufacturing the forms of the invention with white or other light colored plastic is preferred.

Fabrication of forms 700 from flexible materials allows forms 700 to provide curved walkways and paved areas. According to an embodiment of the present invention, forms 700 allow a radius of curvature as small as 12 inches; larger radii can be used. Upper guide bracket 720 (FIG. 1A) retains its shape and is less prone to warping even with a small radii of curvature because of its enhanced wall thickness. Thinner guide brackets 725, 755 and 760 are more flexible and allow smaller radii of curvature than with extruded aluminum or with other forms configurations. Guide brackets 725, 755 and 760 can flex back to their initial position after use.

Because both channels 710 and 750 are not deformed at the ends of form 700 when form 700 is forced into a small radius of curvature, segment connectors 800 can still be used even though the channels along the remainder of the form may be deformed.

Figure 3A:
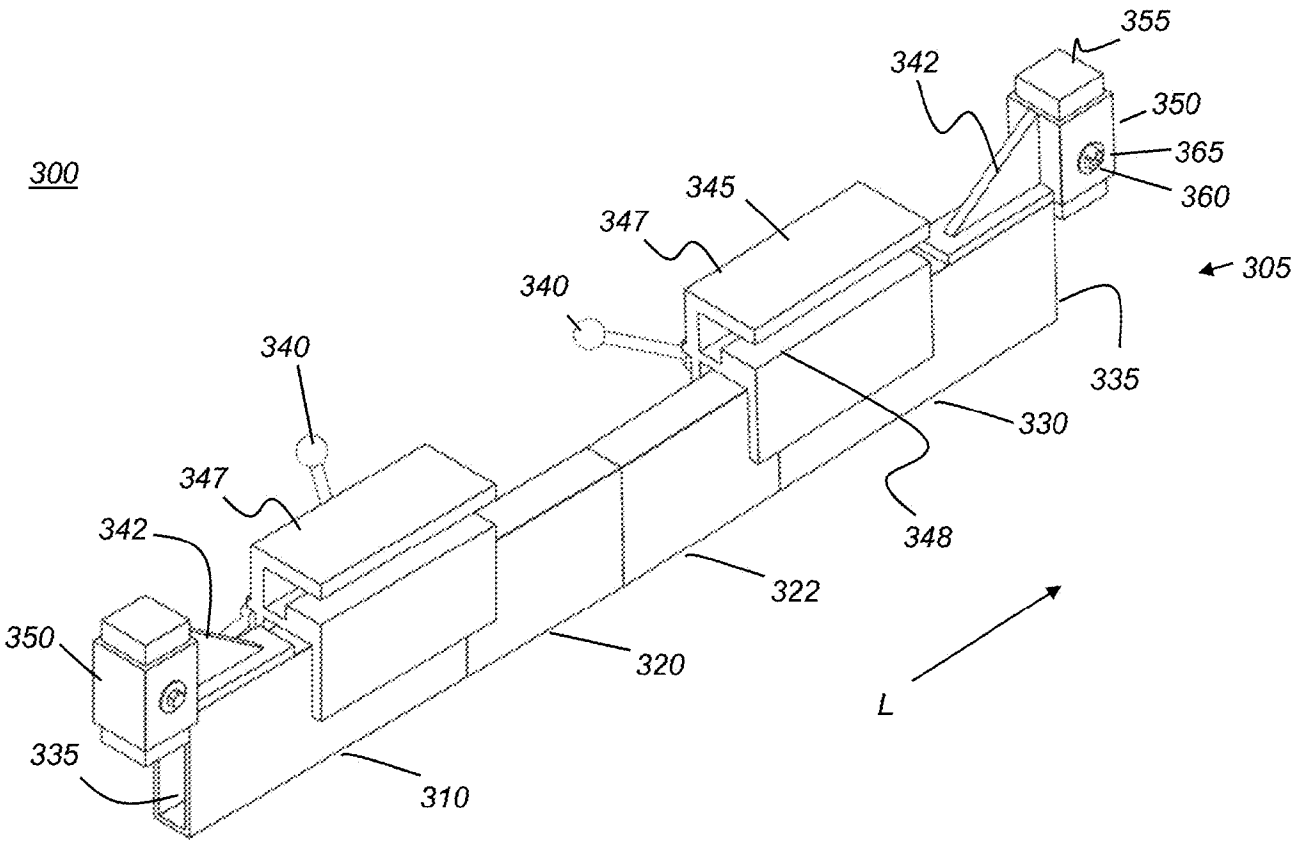
FIG. 3A is a perspective view that shows a screed according to an embodiment of the present invention.
Figure 3C:
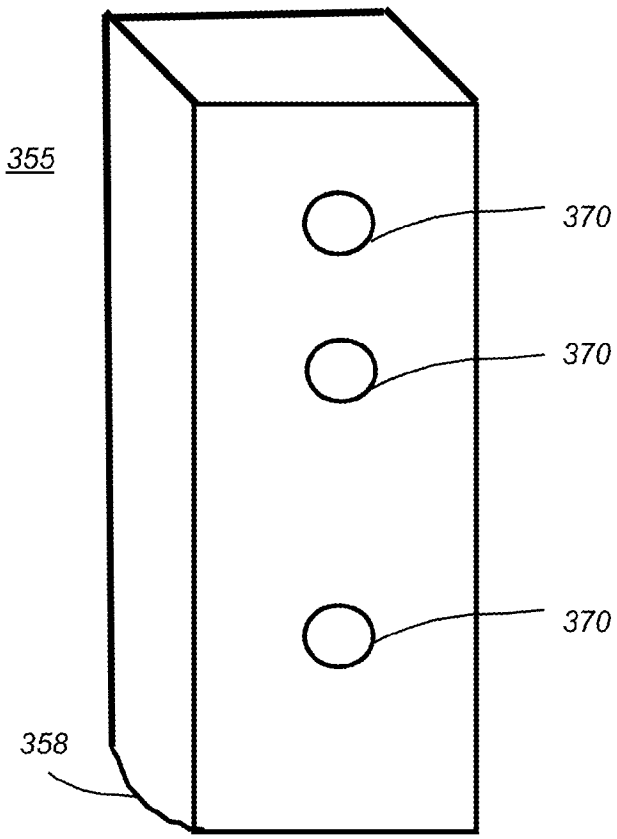
FIG. 3C is a perspective view that shows a height selection block with a modified seat surface profile.
Figure 3B:
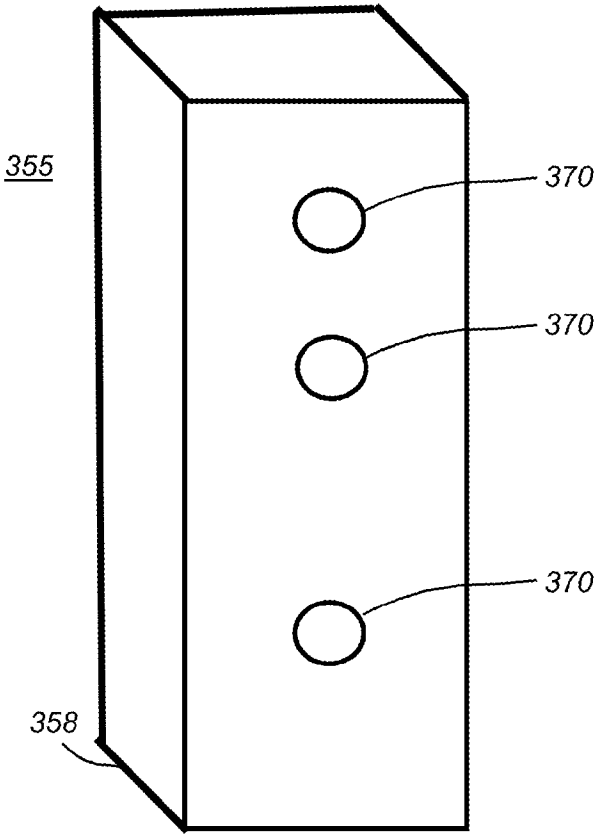
FIG. 3B is a perspective view that shows a height selection block.

FIG. 3A shows a screed 300 of the invention. Screed 300 is a leveling device. However, unlike screeds commonly used in the construction industry, screed 300 is reusable, is easy to assemble, and is adjustable such that it assists in saving labor while accurately leveling base and sub base particulate materials at different levels for proper support of finished paving materials such as paving blocks, bricks and concrete. A screed body 305 is substantially rectangular, can be made of metal such as steel or aluminum, or fiberglass or other composite material, and is formed of two or more coupled sections, shown in FIG. 3A as sections 310, 320, 322, and 330. Note that various other materials, such as plastic may be used, or a composite of metal and plastic or of different metals may be used to construct screed 300. FIG. 3B shows one of the height selection blocks 355 used for height adjustment at each end of screed 300. Each height selection block 355 has a seat surface 358 that slides along the top of forms 700 and has holes 370 for height adjustment. FIG. 3C is a perspective view that shows a height selection block with a modified seat surface profile along seat surface 358. Slidable contact between height selection blocks 355 and screed contact surface 712 on forms 700 provides a reduced-friction interface that allows the assembled screed 300 to be dragged or pushed along the trench in order to distribute particulate or finished paving materials at the desired height. Height selection block 355 can be a plastic or metallic material, or a reduced-friction composite material, for example.

Referring to FIG. 3A, screw handles 340 affix clamps 345 to screed body 305 and affix sections 310, 320, 322, and 330 together to create a strong and complete screed body 305 from modular components. Clamps 345 have bucket accepting couplings 347, each with a slot 348 for rapid and easy insertion of the lip of a bucket or blade of earthmoving machinery such as a Skid Steer Loader S 100. Slot 348 extends in the length direction L (longitudinal axis) of the screed 300. By means of bucket accepting couplings 347, commonly available excavating buckets on earthmoving apparatus can be used to quickly couple screed 300 to earthmoving equipment and facilitate machine powered use of screed 300, with further savings of time and labor. The position of the at least one bucket accepting coupling 347 along the length direction of the screed is adjustable. Slot 348 may be of fixed width, that is, fixed jaw size, or may provide adjustable jaw size, such as using a clamp.

Outside ends 335 of sections 310 and 330, away from central section 320, have wings or projections 342. Projections 342 extend beyond screed body 305 and terminate in an open vertical channel 350 that provides a cavity with a square opening in the embodiment shown. Height selection block 355 fits into open vertical channel 350, and is fixed in position within the cavity provided by open vertical channel 350 by a bolt 360 which passes through holes 365 in open vertical channel 360 and also passes through one of holes 370 in height selection block 355, shown in FIGS. 3B and 3C. According to an alternate embodiment of the present invention, a clamp is used to adjust and hold height selection block 355 in position within vertical channel 360.

Note that seat surface 358 as shown in FIGS. 3B and 3C can be flat or can have a curved profile designed to facilitate slideable contact along the top contact surface 712 of the forms 700. The profile shown in FIG. 3B is provided by way of example and not by way of limitation. The plurality of holes 370 in height selection block 355 allows for easy selection of different descent depths for screed body 305. Depth indicators 110 on the forms (FIGS. 1A and 1B) can be used to help determine the height setting of height selection blocks 355 of screed 300.

Still referring to FIG. 3A, bolt 360 is secured in place by a nut or other fastener (not shown). Note that projections 342, while designed to ride atop forms 700, do not extend far beyond the forms. This allows anchors 290 secured by connectors 800 to forms 700 to be driven into the ground without interference with screed 300. Connectors 800 are designed so that the portion which passes under the projections and height selection blocks 355 does not interfere with the operation of screed 300.

Figure 4A:
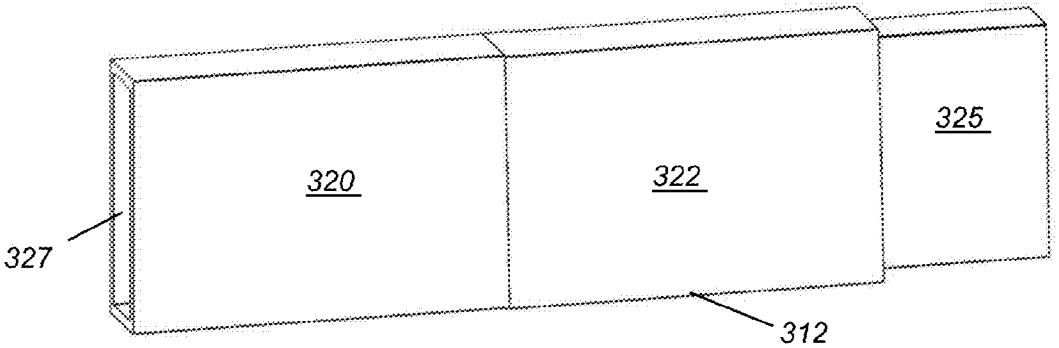
FIG. 4A shows the screed in a level configuration.
Figure 4B:
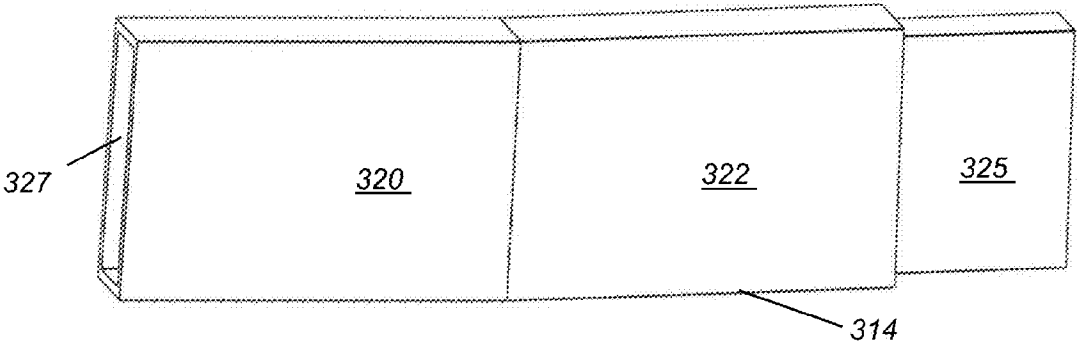
FIG. 4B shows the screed in a convex profile configuration.
Figure 4C:
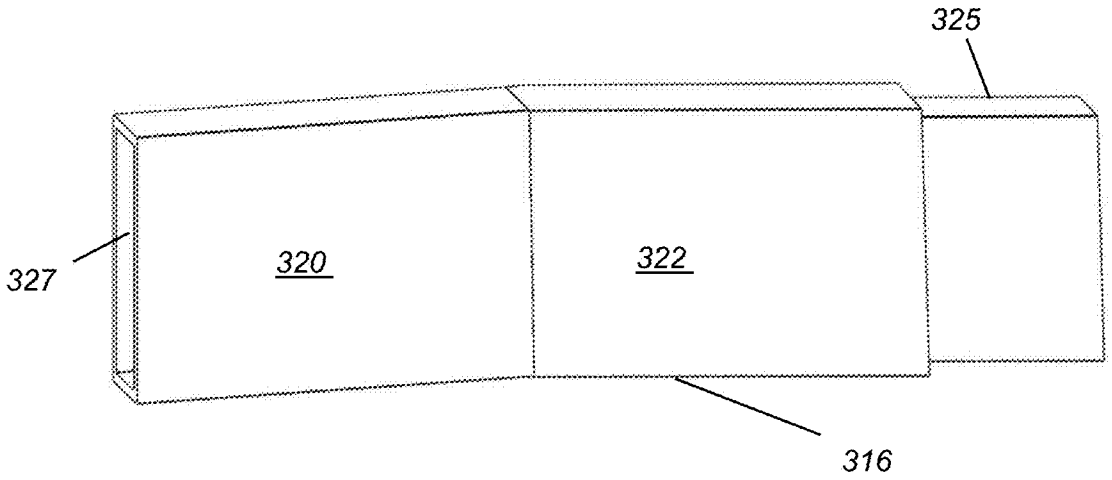
FIG. 4C shows the screed in a concave profile configuration.

FIGS. 4A, 4B and 4C show different arrangements of central sections 320 and 322 of screed 300 that can be used depending upon curvature changes, such as changes needed due to drainage differences or aesthetic preferences for a specific project. FIG. 4A shows central sections 320 and 322 leveled, for use when a level top surface for particulate matter is desired. A bottom surface 312 of screed 300 lies completely flat, with a flat profile so that screed 300 can shape particulate material between forms 700 to be level or to follow the contour of the ground.

In places where a flat profile would be undesirable, such as a walkway between buildings, the arrangement of FIG. 4B can be used. Here, central sections 320 and 322 provide a bottom surface 314 that has a convex curvature profile. This imparts a concave top surface to particulate matter that is deposited between forms 700. Alternately, the arrangement of FIG. 4C shows a bottom surface 316 that has a concave curvature profile. This imparts a convex top surface to particulate matter that is deposited between forms 700. The bottom surface profile that is used can be determined by the pre-formed shape of sections 320 and 322 or can be determined by how these sections are coupled together, allowing the same components to provide a flat, convex, or concave surface profile for particulate material or finished paving material. It will be understood that any number of angles can be supported by central sections manufactured with different angles or coupled at different angles (not shown). Additionally, central sections of screed 300 are not limited to a single point of discontinuity and can also be curved. Also, sections 310, 320, 322, and 330 can be constructed in different lengths to enable a longer or shorter screed, or additional sections can be removed for a shorter screed length or added for a longer screed length according to the needs of a particular site.

Screed sections 320 and 322 can have tongue protrusions 325 at one end and sleeve openings 327 at the opposite end as fittings for joining to additional sections. Protrusions 325 can be configured to fit into openings 327 for each section, to provide a coupling arrangement that is similar to a mortise and tenon joint familiar to woodworkers. Note that screed 300 may also be manufactured with expanding sections that slide over each other, bolt or fasten together in some way, or in some other combination that allows coupling of screed sections together to allow variable screed length and curvature profile.

In operation for forming a supporting base, screed 300 is dragged across each layer of particulate material that is spread between the forms, producing a uniform, compact layer. Screed 300 can be dragged by hand for smaller projects. For larger projects, screed 300 can be moved along with a bucket attachment that creates compressive downward force; this type of operation can use a walk-behind device such as a skid steer Dingo TX 427 Wide Track from Toro Corporation, Bloomington, Minn., or use operator-driven machinery such as a Skid Steer Loader S100 from Bobcat Co., division of Doosan Infracore International, Seoul, South Korea. Multiple passes with screed 300 can be employed for a particular layer since compacting and addition of additional particulate material can be necessary for achieving a base with the proper characteristics for supporting the finished layer.

Figure 5A:
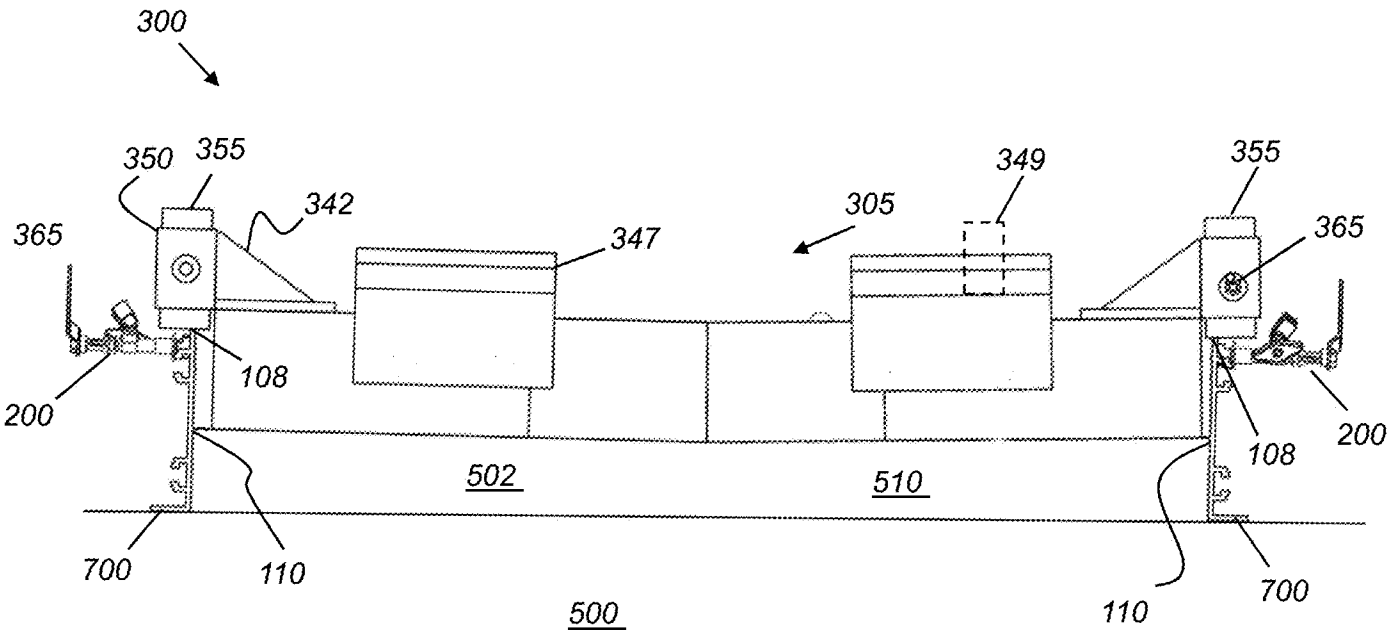
FIG. 5A shows a front view of a screed for use in applying particulate materials.
Figure 5B:
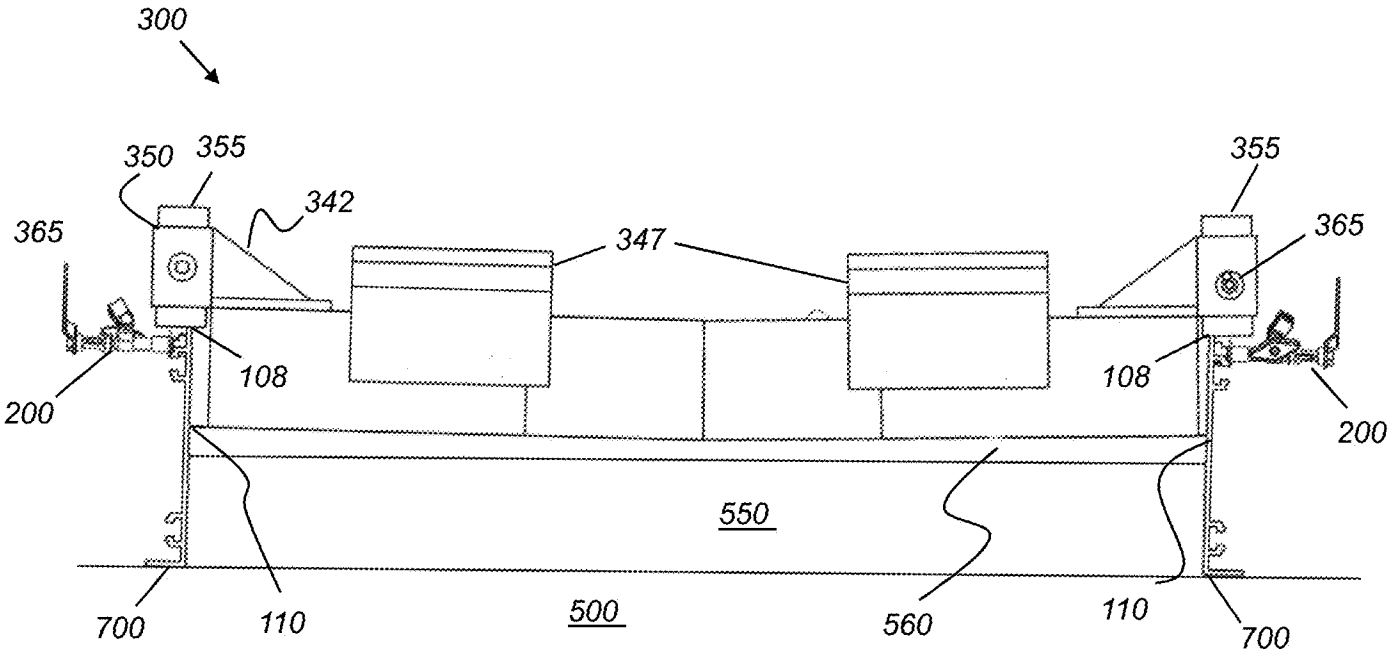
FIG. 5B shows a front view of a screed for use in applying paving materials according to an alternate embodiment of the present invention.

Some installations, for example, require a two-inch base for concrete projects. FIGS. 5A and 5B are side views taken between forms 700, respectively, that shows forms 700 in place on ground 500 with screed 300 in contact with forms 700 and configured for movement along piecewise parallel forms 700. In order to conform to standard practice, two inches of a base 510, such as gravel in this case, must be placed against ground 500 and within a gap 502 prior to overcoating with three inches of concrete to be poured above base 510.

In FIG. 5A, screed 300 is shown leveling base 510. As described previously, height selection blocks 355 are fitted into open vertical channels 350, and are fixed in open vertical channels 350 by bolts 360 which have been inserted through holes 365 in open vertical channels 360 and through the hole 370 in height selection blocks 355. With this arrangement, screed 300 is leveled by contact with form 700 along screed contact surface 712, causing screed 300, in turn, to level and compact base 510 at the desired height. Note that the depth to which screed body 305 descends between forms 700 matches depth indicators 110 on forms 700, which provides a simple checking mechanism to verify that particulate material has been leveled at the correct height. Time consuming raking and re-leveling, which can be needed when particulate material is found to be deposited in an uneven or elevated manner, is eliminated by the accurate depth adjustment of screed 300 by height selection blocks 355. Also note that if a level of particulate material is desired that does not match the level of opposing forms 700, height selection blocks can be set to select different heights for each side of screed 300, and the angle of the particulate material between forms 700 can be modified.

Paving stone projects often require two base layers, as shown in FIG. 5B. In this cross sectional view, screed 300 has been employed in contact with forms 700 in the manner shown in FIG. 5A, but with two different positions for height selection blocks 355. A four-inch sub base 550, such as gravel, supports a one-inch fluff layer 560, such as sand, which in turn supports a finished layer of paving stones (not shown). Other finished surface materials such as flagstone or bricks can also be used.

Figure 5C:
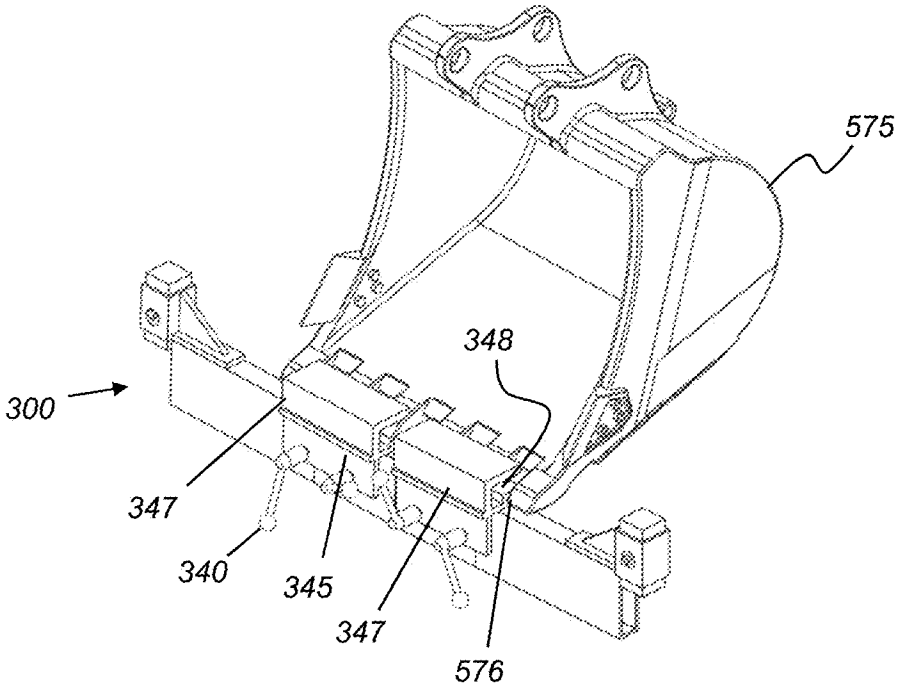
FIG. 5C shows an earthmoving bucket inserted into bucket accepting couplings in a screed.

FIG. 5C shows a lip 576 of a bucket 575 inserted into bucket-accepting couplings 347 secured in clamps 345 of screed 300. As shown, screw handles 340 are used to clamp sections of screed 300 to form one solid unit. Bucket 575, attached to some kind of earthmoving apparatus such as a Skid Steer Loader S 100, is inserted into screed 300 by moving lip 576 of bucket 575 into slot 348 of bucket accepting couplings 347 or alternatively by manually moving screed 300 toward bucket 575 so that bucket accepting couplings 347 accept lip 576 of bucket 575. Note that one or more additional clamps 349 may optionally be provided with clamp 345 to affix bucket accepting couplings 347 of screed 300 to bucket 575, as shown in outline in FIG. 5A. Once screed 300 is coupled to bucket 575, the earthmoving apparatus operator places the screed 300 atop forms 700 and pulls or pushes particulate material between forms 700 to the appropriate depth as dictated by the settings of height selection blocks 355, applying compressive pressure so that the screed maintains its position atop forms 700 while spreading the particulate material at the proper depth.

Figure 6A:
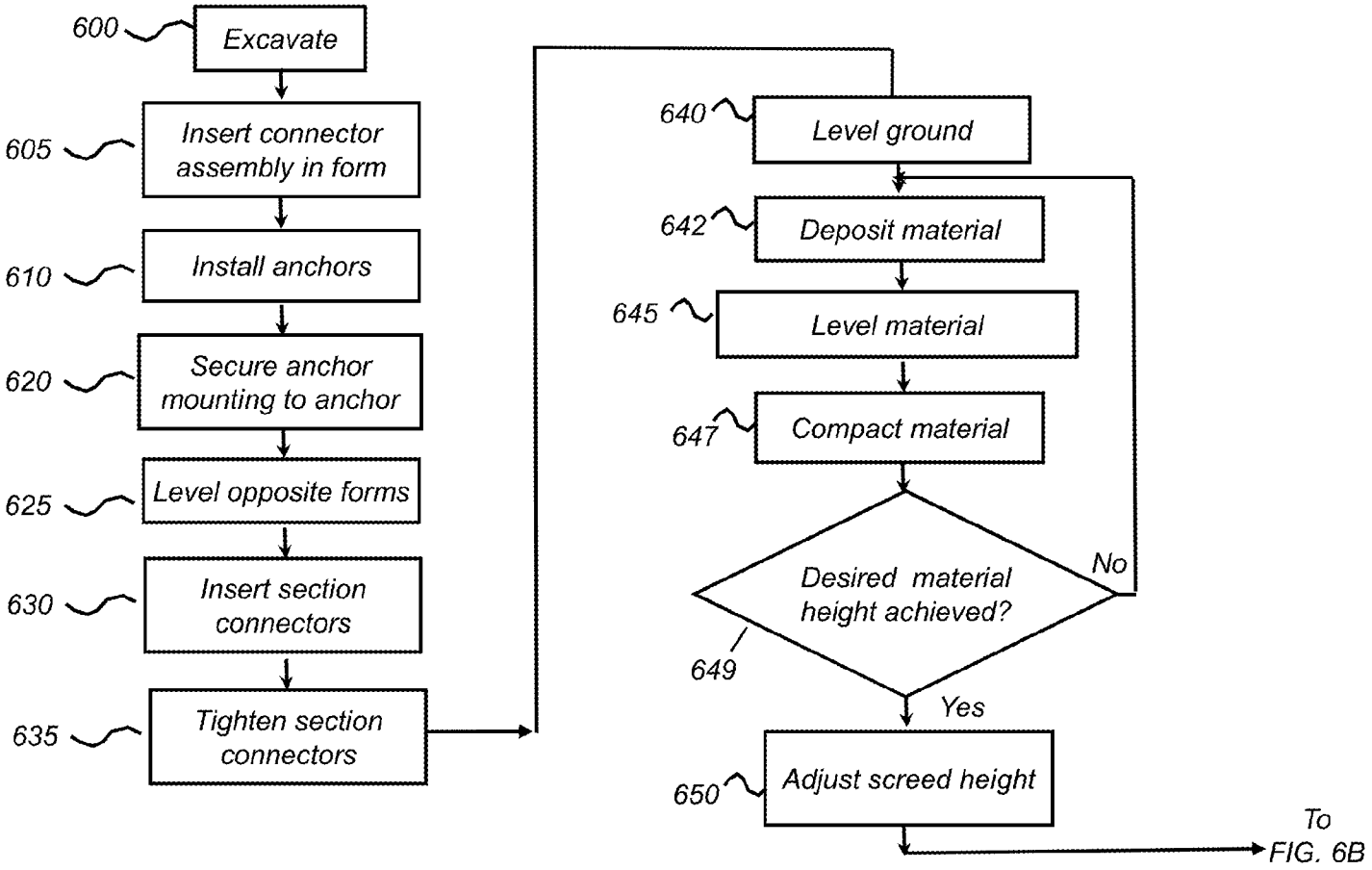
FIGS. 6A and 6B provide a flow chart of a process for walkway construction using an embodiment of the present invention.
Figure 6B:
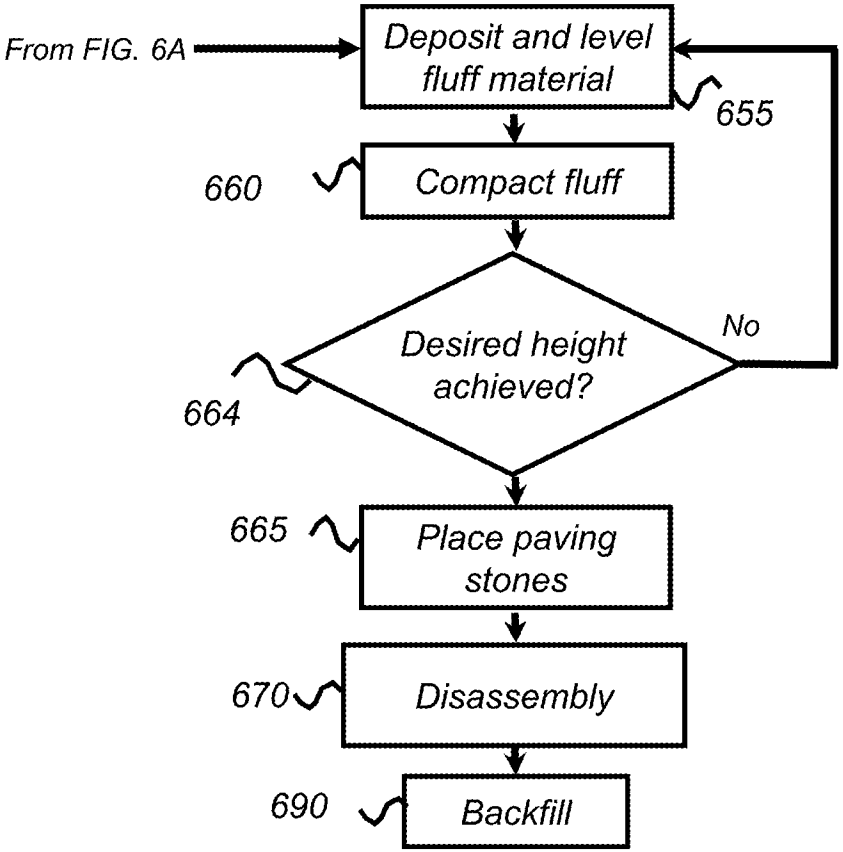

Steps for installation of a paving stone walkway using an embodiment of the present invention are given in the flow chart shown in FIGS. 6A and 6B. It will be understood that this description is employed by way of illustrative example only and not by way of limitation.

Referring to FIG. 6A, excavations are made only inches wider than the desired finished surface in an excavation step 600. In a connector insertion step 605, connectors 800 are inserted into the channels 710, 750 on the connector side 708 of forms 700. Anchors 290 are inserted through coupling member 205 in anchor mounting element 820 in an anchor installation step 610, loosely joining form 700 to anchor 290. Each anchor 290 is pounded into the ground to create a secure point of connection to the earth. When the anchor 290 can't be pounded in, due to obstruction by a rock or other object, the mounting 820 is moved along the channel, allowing anchor 290 to move without affecting the position of form 700 in either a vertical or horizontal direction. Note that, in addition to being able to be moved laterally, the anchor mounting elements 820 can be set to accept anchor 290 pounded into the earth at any angle. This allows setting form 700 in place with enough strength to withstand the pressure of the particulate material placed between forms 700 even in the event of a rock blocking the preferred position for anchor 290.

Continuing with the FIG. 6A sequence, after anchors 290 are pounded into place, tightening knobs 210 are tightened, anchoring form 700 to the earth in a securing step 620. Another advantage of embodiments of the present invention is that additional anchors 290 and anchor mounting elements 820 can be added at any previously unoccupied point along channels 710, 750 at any time. Should it become apparent that stronger anchoring is necessary during the process of preparing sub base 550 or fluff layer 560, additional anchors 290 and anchor mounting elements 820 can be added at any point necessary without the need for disassembling previously assembled anchors 290 and anchor mounting elements 820.

When one form 700 is secured in place, then the complementary, piecewise-parallel form 700 along the opposite edge of the walkway is anchored by the same method. Note that the position of form 700 can be easily adjusted to the specifications of the job because anchor mounting elements 820 are readily adjustable in a leveling step 625. For example, if the forms 700 on either side of the walkway are to be level with one another, the relative heights of the forms can be quickly adjusted to level by loosening tightening knob 210, adjusting the height of form 700, and then re-tightening tightening knob 210. Note that screed 300 can be placed between forms 700 to assist in making sure that the distance between forms 700 is proper. When the walkway or other structure is straight, the task of adjusting anchor mounting elements 820 so that opposing forms 700 are parallel is straightforward. When the walkway to be created is curved, adjusting anchor mounting elements 820 so that opposing forms 700 are piecewise parallel is facilitated.

In a connector insertion step 630, section connectors 800 are inserted into channels 710, 750 of the form 700 that has been secured to the earth, and to each additional form 700 that is moved into an adjacent position. Additional adjacent form 700 butts up against form 700 which is already secured to the earth. Note that butting the ends of forms 700 to each other and connecting the forms 700 in a connection step 635 assists in positioning additional adjacent form 700 when the previously described process for securing forms 700 to the earth is repeated. As forms 700 are added, additional adjacent forms 700 tend to follow the same line that is established by the top or bottom of the initially installed form 700. In this way, the tedious task of leveling or contour filling is minimized. In common practice, a string line or laser is used to establish the top position of forms 700. In contrast to using wood or metal forms, the easy vertical positioning of forms 700 provides a simplified mechanism that can readily match a string line or laser leveling device. Also, use of forms 700 prevents the need for large numbers of anchors, as is necessary for use with wood forms due to warping, bowing and twisting.

Continuing with the sequence in FIG. 6A, when the desired number of forms 700 have been installed, ground 500 is leveled. This can be done with at least one pass of screed 300 in a leveling step 640. In a dumping step 642, particulate material such as gravel or sand is placed between forms 700. In a preferred embodiment, sub-base 550, in this case gravel, is first placed between the forms. Unlike practices of the prior art, where multiple small piles of gravel are placed between prior art forms for tedious raking operations, larger piles of gravel can be deposited at one time between the forms. Screed 300 is used to push or pull sub base 550 to the desired level in a leveling step 645. Projections 342 on each end of screed 300 fit over the top of forms 700 and restrict the descent of screed body 305 into the space between forms 700. The depth of descent of screed body 305 is controlled by the selection of hole 370 through which bolt 360 is inserted in height selection block 355. The bottom of height selection block 355 provides seat surface 358 upon which screed 300 can ride atop screed contact surface 712 of forms 700. Sub-base 550 is compacted in a compacting step 647 with a plate compactor such as the BPU 2540A Reversible Vibratory Plates provided by the Wacker Neuson Company of Munich, Germany. Note that steps 642, 645 and 647 can be carried out a number of times until the desired height and compaction of sub-base 550 is achieved, as determined in a verification step 649. After sub base 550 has been installed, the depth of descent of screed body 305 is reduced by selecting the appropriate hole 370 through which bolt 360 is inserted in height selection block 355 in a screed adjustment step 650.

FIG. 6B shows additional steps in the process. Fluff layer 560, in this case sand, is deposited atop sub base 550 in a dumping and leveling step 655. As with step 640, large piles of sand can be deposited between forms 700. In step 655, screed 300 is used to push or pull fluff layer 560 to the desired level. Fluff layer 560 is compacted in a compacting step 660 with a plate compactor or other suitable device. Note that steps 655 and 660 can be performed a number of times until the desired height and compaction of sub-fluff layer 560 is achieved, as checked in a verification step 664. In a stone installation step 665, paving stones are installed on top of the base prepared by this process.

A disassembly step 670 then follows, in which the forms structure is systematically removed. Anchor mounting elements 820 are loosened and then removed, disconnecting forms 700 from anchors 290. Forms 700 are removed from the ground. Sectional connectors 800 are removed. Anchors 290 are then removed. Backfilling the area of overdigging occurs in a backfill step 690 and the installation is complete.

Screed 300 can be moved along the length of screed contact surface 712 of forms 700 by hand. Alternately, screed 300 can be moved using machinery, which is advantageous where the width of the gap between forms 700 is large, for example, when this width is 4 feet or more. Because some projects dictate that screed 300 be moved by machinery, clamps 345 of screed 300 have bucket accepting couplings 347 for insertion of a bucket for equipment often used in construction. Once the lip of the bucket is inserted into slot 348 of bucket accepting couplings 347, the frontloader or other piece of mobile earthmoving apparatus drags the screed along the top contact surface 712 of the forms 700 to achieve the desired profile for deposited particulate material. Note that the length of screed 300 can be adjusted by using sections of different length dimensions, or by adding additional sections. In practice, embodiments of the present invention are particularly well suited for use for widths between 15 inches and 20 feet; however, embodiments of the present invention are not limited to those dimensions.

Use of forms 700, connectors 800, anchor mounting elements 820, and screed 300 reduces the time necessary for preparation of layers supporting the finished materials, and in the case of concrete, can reduce the time required for installing that finished material. Due to the accurate leveling of large amounts of material that is placed between the forms 700, tedious and error-prone hand raking can be greatly reduced or eliminated. Also, placing material by hand with multiple wheelbarrow loads may no longer be necessary. Construction crews can substantially cut the cost and time of paving projects because the forms 700, connectors 800, anchor mounting elements 820, and screed 300 are reusable, light weight, and easy to configure and manipulate. Thus, crews using the described solution can produce a superior product that meets or exceeds industry standards with reduced time and labor. Screed 300 can be used by hand or with any of a number of types of earth-moving apparatus and related equipment that have a blade or bucket, including systems that seat an operator and walk-behind systems, for example.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. The invention is defined by the claims.

The invention claimed is:

1. A form assembly for installation of paving materials, the form assembly comprising:

a) one or more elongated form sections, wherein each of the one or more elongated form sections has a first side wall for facing the paving material and an opposite second side wall, wherein a first longitudinal channel is defined between corresponding first and second brackets that extend from the second side wall, wherein an upper form section extends between the first bracket and an upper screed contact surface, wherein the upper screed contact surface is defined between the first side wall and the second side wall and is orthogonal to the first side wall, wherein a lower form section extends between the second bracket and a base that is opposite the upper screed contact surface, and wherein a first wall thickness between the first and second side walls in the upper form section exceeds, by at least 10%, a second wall thickness between the first and second side walls in the lower form section, and wherein a second channel depth of a second longitudinal channel defined between third and fourth brackets that extend from the second side wall in the lower form section does not exceed 0.9 times a first channel depth of the first longitudinal channel, wherein the first and second channel depths are in a direction extending outward from the second side wall;

b) a plurality of connector elements for joining adjacent elongated form sections, wherein each connector element has at least one fastener and a crosspiece member that seats within the at least the first longitudinal channel of the adjacent form sections; and c) one or more anchor mounting elements, wherein each anchor mounting element has a first coupling member that is configured to fit into at least the first longitudinal channel of the form section and a second coupling member that is configured for coupling to a mounting anchor.

2. The form assembly of claim 1 further comprising a foot element extending outward from the second side wall and extending along the base for the length of the one or two form sections.

3. The form assembly of claim 1 wherein the one or more elongated form sections are formed from a plastic material.

4. The form assembly of claim 1 wherein the one or more elongated form sections are flexible and wherein the minimum radius of curvature of the one or more elongated form sections is three feet.

5. The form assembly of claim 1 wherein the one or more elongated form sections further have one or more protruding ridges within the first longitudinal channel and spaced apart from the first and second brackets that define the first longitudinal channel and wherein the one or more protruding ridges urge each connector element within the first longitudinal channel against both the first and the second brackets.

6. A form assembly for installation of paving materials, the form assembly comprising:

a) one or more elongated form sections, wherein each of the one or more elongated form sections has a first side wall for facing the paving material and an opposite second side wall, wherein an upper first longitudinal channel is defined between corresponding first and second guide brackets that extend from the second side wall and a lower longitudinal channel is defined between corresponding third and fourth guide brackets that extend from the second side wall, wherein the first guide bracket is 1.5 times thicker than the second guide bracket, wherein an upper form section extends between the first guide bracket and an upper screed contact surface, wherein the upper screed contact surface is defined between the first side wall and the second side wall and is orthogonal to the first side wall, wherein a lower form section extends between the second guide bracket and a base that is opposite the upper screed contact surface, and wherein a first wall thickness between the first and second side walls in the upper form section exceeds, by at least 10%, a second wall thickness between the first and second side walls in the lower form section, and wherein a second channel depth of the lower longitudinal channel does not exceed 0.9 times a first channel depth of the first longitudinal channel, wherein the first and second channel depths are in a direction extending outward from the second side wall;

b) a plurality of connector elements for joining adjacent elongated form sections, wherein each connector element has at least one fastener and a crosspiece member that seats within either the upper or lower longitudinal channel of the adjacent form sections; and c) one or more anchor mounting elements, wherein each anchor mounting element has at least a first coupling member that is configured to fit into at least the upper longitudinal channel of a form section and a second coupling member that is configured for coupling to a mounting anchor.

7. The form assembly of claim 6 wherein the one or more elongated form sections are formed from a plastic material.

8. The form assembly of claim 6 wherein the one or more elongated form sections are flexible and wherein the minimum radius of curvature of the one or more elongated form sections is three feet.

9. The form assembly of claim 6 further comprising a foot element extending outward from the second side wall and extending along the length of the one or more form sections.

10. A form assembly for installation of paving materials, the form assembly comprising:

a) at least first and second flexible, elongated form sections, wherein each of the elongated form sections has a first side wall for facing the paving material and an opposite second side wall that has an upper longitudinal channel and a lower longitudinal channel, wherein each longitudinal channel is defined between corresponding brackets;

wherein an upper form section extends between the upper longitudinal channel and an upper screed contact surface, wherein the upper screed contact surface is defined between the first side wall and the second side wall and is orthogonal to the first side wall, wherein a lower form section extends between the first longitudinal channel and a base that is opposite the upper screed contact surface, and wherein a first wall thickness between the first and second side walls in the upper form section exceeds, by at least 10%, a second wall thickness between the first and second side walls in the lower form section, and wherein a second channel depth defined between the second side wall and the corresponding brackets of the second longitudinal channel does not exceed 0.9 times a first channel depth defined between the second side wall and the corresponding brackets of the first longitudinal channel;

b) a plurality of connector elements for joining the at least first and second elongated form sections, wherein each connector element has at least one fastener that is held by a crosspiece member that seats within the at least the first longitudinal channel of the adjacent form sections; and c) one or more anchor mounting elements, wherein each anchor mounting element has a foot member that is configured to fit into at least the upper longitudinal channel of the at least the first and second form sections and to couple the corresponding section to a mounting anchor, wherein each anchor mounting element further has an adjustment member that defines the position of the anchor mounting element out from the second side wall.

11. The form assembly of claim 10 wherein the one or more elongated form sections are formed from a plastic material.

12. The form assembly of claim 10 wherein the second side wall further has protrusions that extend lengthwise along the form section and protrude partially into the upper and lower longitudinal channels.

13. The form assembly of claim 10 wherein the minimum radius of curvature of the one or more elongated form sections is three feet.

14. The form assembly of claim 10 further comprising a foot element extending outward from the second side wall and extending the length of the at least first and second form sections.

15. The form assembly of claim 10 wherein the one or more elongated form sections are extruded from a polyvinyl chloride.

* * * * *